US012252370B2

(12) United States Patent
Mita et al.

(10) Patent No.: US 12,252,370 B2
(45) Date of Patent: Mar. 18, 2025

(54) METHOD FOR CONVEYING SHEET IN POST-PROCESSING APPARATUS

(71) Applicant: CANON KABUSHIKI KAISHA, Tokyo (JP)

(72) Inventors: Takuro Mita, Kanagawa (JP); Taro Ishifune, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 18/194,430

(22) Filed: Mar. 31, 2023

(65) Prior Publication Data

US 2023/0331509 A1 Oct. 19, 2023

(30) Foreign Application Priority Data

Apr. 18, 2022 (JP) ..... 2022-068471

(51) Int. Cl.

| | |
|---|---|
| ***B65H 39/10*** | (2006.01) |
| ***B65H 29/12*** | (2006.01) |
| ***B65H 29/60*** | (2006.01) |
| ***B65H 33/00*** | (2006.01) |

(52) U.S. Cl.

CPC ..... *B65H 39/10* (2013.01); *B65H 29/125* (2013.01); *B65H 29/60* (2013.01); *B65H 33/00* (2013.01); *B65H 2511/416* (2013.01); *B65H 2513/51* (2013.01); *B65H 2515/40* (2013.01); *B65H 2515/805* (2013.01)

(58) Field of Classification Search

CPC ..... B65H 2511/416; B65H 2515/40; B65H 2513/51; B65H 2515/805; B65H 29/60; B65H 39/10; B65H 29/125; B65H 31/36; B65H 29/145; B65H 2301/4213; B65H 2301/42194

See application file for complete search history.

(56) References Cited

U.S. PATENT DOCUMENTS

| | | | | |
|---|---|---|---|---|
| 2007/0045924 | A1* | 3/2007 | Kamiya | B65H 31/34 270/58.1 |
| 2014/0061990 | A1* | 3/2014 | Gamo | B65H 29/125 270/1.01 |
| 2015/0307305 | A1* | 10/2015 | Saito | B42C 19/08 271/3.19 |

FOREIGN PATENT DOCUMENTS

| | | | |
|---|---|---|---|
| JP | 2004-085982 | A | 3/2004 |
| JP | 2007-070079 | A | 3/2007 |
| JP | 5365269 | B2 | 12/2013 |

* cited by examiner

*Primary Examiner* — Jennifer Bahls

(74) *Attorney, Agent, or Firm* — Canon U.S.A., Inc. IP Division

(57) ABSTRACT

A post-processing apparatus includes a conveyance path, a buffer unit, a post-processing unit, and a processor. The conveyance path receives a sheet conveyed from a conveyance apparatus in a stage preceding the post-processing apparatus. The buffer unit forms a sheet bundle constituted by sheets. The post-processing unit loads the sheet bundle performs post-processing on the sheet bundle. The processor controls conveyance of the sheets and the sheet bundle and obtains, in a case of a delay amount, a delay amount of the sheet conveyed from the conveyance apparatus in the stage or a delay amount of a preceding other sheet bundle conveyed from the buffer unit to the post-processing unit. The processor sets a shift amount between plural sheets based on the delay amount obtained by the at least one processor.

20 Claims, 14 Drawing Sheets

FIG. 5A

| REQUIRED ALIGNMENT CAPABILITIES | DELAY AMOUNT | SHIFT AMOUNT |
|---|---|---|
| LOW | T_delay≥5mm | 25mm |
| | 5mm>T_delay | 30mm |
| HIGH | — | 30mm |

FIG. 5B

| REQUIRED ALIGNMENT CAPABILITIES | DELAY AMOUNT | SHIFT AMOUNT |
|---|---|---|
| LOW | 15mm>T_bndl_delay1≥5mm or 15mm>T_bndl_delay2≥5mm | 25mm |
| | 5mm>T_bndl_delay1 and 5mm>T_bndl_delay2 | 30mm |
| HIGH | — | 30mm |

FIG. 5C

| REQUIRED ALIGNMENT CAPABILITIES | DELAY AMOUNT | SHIFT AMOUNT | ADJUSTMENT TARGETS | DISCHARGE DESTINATION |
|---|---|---|---|---|
| LOW | T_delay≥15mm | 25mm | 2 | — |
| | 15mm> T_delay≥5mm | 25mm | 1 | — |
| | 5mm>T_delay | 30mm | — | — |
| HIGH | — | — | — | UPPER TRAY |

METHOD FOR CONVEYING SHEET IN POST-PROCESSING APPARATUS

BACKGROUND

Field

The present disclosure relates to a method for conveying a sheet in a post-processing apparatus.

Description of the Related Art

A post-processing apparatus executes post-processing (e.g., alignment processing, binding processing, punching processing) on sheets output from an image forming apparatus. The post-processing apparatus includes a buffer section that temporarily holds a plurality of sheets in a stacked state, and a post-processing section that executes post-processing on a sheet bundle. While the post-processing section is executing the post-processing on the sheet bundle, subsequent sheets are held in the buffer section, which enables the image forming apparatus to continue printing onto sheets. In other words, the productivity of the image forming system as a whole is maintained.

Incidentally, Japanese Patent No. 5365269 proposes forming a sheet bundle by displacing a plurality of sheets in a conveyance direction such that the sheets overlap in the buffer section. This is said to improve the alignment accuracy of sheet bundles in the post-processing section. In Japanese Patent No. 5365269, the amount of displacement of the sheet is a fixed value determined according to the paper type of the sheet.

If sheet conveyance delays occur in a conveyance path from the image forming apparatus to the buffer section, the completion of the sheet bundle containing those sheets will be delayed, and the feeding of the sheet bundle to the post-processing section will also be delayed. As a result, a conveyance interval between that sheet bundle and the subsequent sheet bundle may become too short, which can interfere with normal conveyance. Similarly, if the conveyance of a sheet bundle from the buffer section to the post-processing section is delayed, the feeding of the subsequent sheet bundle to the post-processing section must also be delayed, and the conveyance interval between that subsequent sheet bundle and the sheet bundle following thereafter will become too short, interfering with the normal conveyance of those following sheets.

SUMMARY

According to an aspect of the present disclosure, a post-processing apparatus includes a first conveyance path configured to receive a sheet that has been conveyed from a conveyance apparatus in a stage preceding the post-processing apparatus, and to convey the sheet, a buffer unit configured to form a sheet bundle constituted by a predetermined number of sheets by stacking the predetermined number of sheets conveyed from the first conveyance path while shifting the sheets in a conveyance direction, a second conveyance path connected to the buffer unit and configured to convey the sheet bundle, a post-processing unit configured to load the sheet bundle conveyed from the second conveyance path and to perform post-processing on the sheet bundle, and at least one processor configured to perform operations including controlling conveyance of the sheets and the sheet bundle, obtaining, in a case of a delay amount, a delay amount of the sheet conveyed from the conveyance apparatus in the stage or a delay amount of a preceding other sheet bundle conveyed from the buffer unit to the post-processing unit, and setting a shift amount between plural sheets of the sheets constituting the sheet bundle in the buffer unit based on the delay amount obtained by the at least one processor.

Further features of the present disclosure will become apparent from the following description of exemplary embodiments (with reference to the attached drawings).

BRIEF DESCRIPTION OF THE DRAWINGS

FIGS. 5A to 5C are tables holding relationships between delay amounts and the like and shift amounts.

DESCRIPTION OF THE EMBODIMENTS

Figure 1:
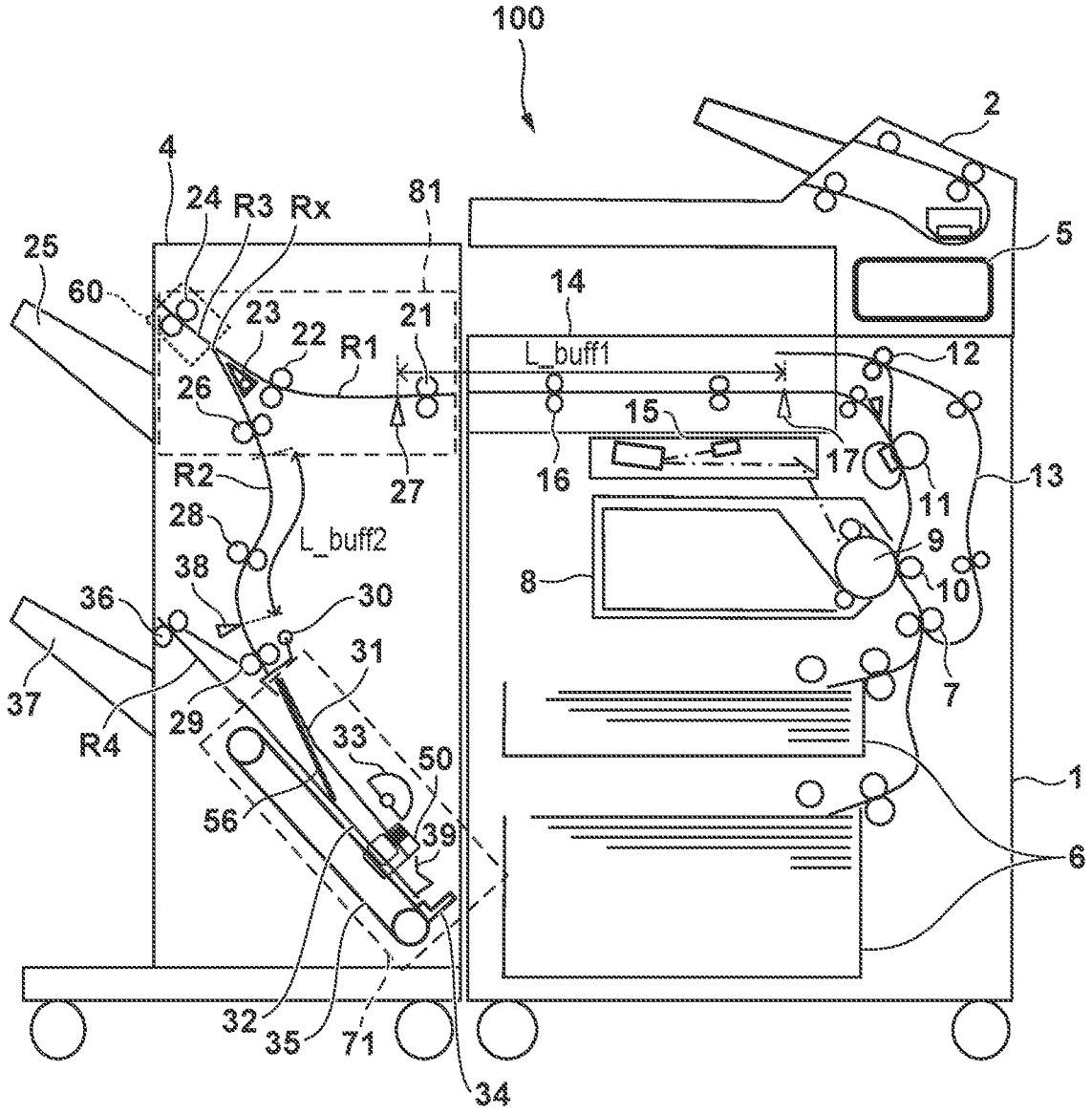
FIG. 1 is a schematic diagram illustrating an overview of an image forming system.

Hereinafter, embodiments will be described in detail with reference to the attached drawings. Note, the following embodiments are not intended to limit the scope of the subject matter of the terms of the claims. Multiple features are described in the embodiments, but limitation is not made to require all such features, and multiple such features may be combined as appropriate. Furthermore, in the attached drawings, the same reference numerals are given to the same or similar configurations, and redundant description thereof is omitted.

First Embodiment

Image Forming System

FIG. 1 illustrates an image forming system 100 including an image forming apparatus 1, an image reading apparatus 2, and a post-processing apparatus 4. The image forming apparatus 1 forms an image on a sheet P. Although any method can be used for the image forming method of the image forming apparatus 1, such as an electrophotographic method, an ink jet method, an offset printing method, or a thermal transfer method, the electrophotographic method will be used here as an example. The image reading apparatus 2 generates image data by reading an image of a document, and outputs the image data to the image forming apparatus 1. The post-processing apparatus 4 executes post-processing (e.g., punching, stapling, binding) on the sheet P. Note that a relay conveyance apparatus that relays the sheet P from the image forming apparatus 1 to the post-processing apparatus 4 may be connected between the image forming apparatus 1 and the post-processing apparatus 4.

The image forming apparatus 1 includes a plurality of paper feed devices 6 which hold a plurality of the sheets P. The paper feed device 6 feeds one sheet at a time at predetermined feed intervals. The sheet P fed from the paper feed device 6 is corrected for skew by registration rollers 7, and is then conveyed to a conveyance nip part by the registration rollers 7. The conveyance nip part is formed by a photosensitive drum 9 rotatably supported in an image forming unit 8, and a transfer roller 10 to which a predetermined transfer voltage is applied. The surface of the photosensitive drum 9 undergoes exposure, charging, latent image formation, and developing in the image forming unit 8, and a toner image is formed thereon as a result. Specifically, an electrostatic latent image is formed by a laser scanner unit 15 using a laser beam to expose the surface of the photosensitive drum 9, which has been uniformly charged. The conveyance nip part transfers the toner image from the photosensitive drum 9 to the sheet P. The sheet P is conveyed to a fixer 11, and the fixer 11 applies heat and pressure to the sheet P and the toner image to fix the toner image onto the sheet P. A horizontal conveyance section 14 conveys the sheet P which has passed through the fixer 11, and discharges that sheet P to the post-processing apparatus 4. When double-sided printing is executed, the sheet P is conveyed to reversing rollers 12, and the reversing rollers 12 execute switch-back conveyance in which the leading end and the following end of the sheet P are reversed. The sheet P is sent to a re-feeding section 13 as a result. The re-feeding section 13 conveys the sheet P to the registration rollers 7 again. Then, an image is formed on the sheet P again.

The post-processing apparatus 4 includes a buffer section 81 and a post-processing section 71. The buffer section 81 includes a bundle forming section 60 that forms a sheet bundle by stacking a plurality of the sheets P and then temporarily holds the sheet bundle. The buffer section 81 may temporarily hold only one sheet P. The buffer section 81 may discharge sheets P to an upper tray 25 without stopping the sheets P. The post-processing section 71 accumulates a predetermined number of sheets P and then performs alignment processing and binding processing. The alignment processing includes alignment processing in the longitudinal direction (the conveyance direction of the sheets P) and alignment processing in the lateral direction (the direction orthogonal to the conveyance direction). The post-processing apparatus 4 has conveyance paths R1, R2, R3, and R4. The conveyance path R1 is a conveyance path from entrance rollers 21 to a branch point Rx. The conveyance path R2 is a conveyance path connecting the branch point Rx with the post-processing section 71. The conveyance path R3 is a conveyance path from the branch point Rx to a conveyance roller pair 24. The conveyance path R4 is a conveyance path from the post-processing section 71 to a discharge roller pair 36. In the following, the end part of the sheet P on the front side in the conveyance direction will be called a "leading end", and the end part of the sheet P on the rear side in the conveyance direction will be called a "following end". Additionally, of the two end parts of the sheet P, the end part that enters the post-processing apparatus 4 first will be called a "first end", and the end part that enters the post-processing apparatus 4 after will be called a "second end". Note that switch-back conveyance may result in the leading end changing from the first end to the second end and the following end changing from the second end to the first end.

The entrance rollers 21 are conveyance rollers that accept the sheet P conveyed from the horizontal conveyance section 14 into the post-processing apparatus 4 and convey that sheet P. The horizontal conveyance section 14 is provided with conveyance rollers 16 that convey the sheet P, and a sheet sensor 17. The sheet sensor 17 detects the leading end and the following end of the sheet P and outputs detection signals. A conveyance distance from a detection position of the sheet sensor 17 to the detection position of a sheet sensor 27 is indicated by "L_buff1".

When the sheet sensor 17 detects the leading end of the sheets P, the image forming apparatus 1 outputs a report signal S1 notifying the post-processing apparatus 4 that a sheet P will be brought in. In the present embodiment, the image forming apparatus 1 outputs the report signal S1 while the sheet P is passing the sheet sensor 17. The post-processing apparatus 4 may start controlling the conveyance of the sheet P based on the timing at which the report signal S1 is received. The report signal S1 may be a signal which is at low level (or high level) while the sheet P is passing the sheet sensor 17, and is at high level (or low level) while no sheet P is passing the sheet sensor 17. In this case, the change in the level of the report signal S1 indicates the passage timing of the leading end and the passage timing of the following end.

The post-processing apparatus 4 includes the upper tray 25 and a lower tray 37. When the discharge destination of the sheet P is the upper tray 25, the sheet P is passed from a conveyance roller pair 22 to the conveyance roller pair 24, and is discharged to the upper tray 25. The conveyance roller pair 22 is a conveyance roller pair provided downstream from the entrance rollers 21 in the conveyance direction of the sheets P. The conveyance roller pair 24 is a conveyance roller pair provided downstream from the conveyance roller pair 22 in the conveyance direction of the sheets P. The conveyance roller pair 24 can rotate both forward and in reverse, and may therefore also be called a "reversing roller pair".

When the discharge destination of the sheet P is the lower tray 37, the conveyance of the sheet P stops temporarily after the following end (the second end) of the sheet P passes a backflow prevention valve 23. The conveyance roller pair 24 then switches the sheet P back, such that the second end of the sheet P changes from the following end to the leading end. The leading end (the second end) of the sheet P is guided to the conveyance path R2 by the backflow prevention valve 23, and is conveyed further downstream by a conveyance roller pair 26. Once the leading end (the second end) of the sheet P reaches the conveyance roller pair 26, the conveyance roller pair 24 changes from a pinching state (a contact state) to an open state (a separated state). In other words, the two rollers constituting the conveyance roller pair 24 separate. This enables the conveyance roller pair 24 to accept a subsequent sheet P. The conveyance roller pair 26 stops temporarily in a state where the conveyance roller pair 26 is pinching the sheet P. When the subsequent sheet P passes a predetermined position, the conveyance roller pair 26 starts rotating in reverse. This causes the sheet P to be conveyed toward the conveyance roller pair 24. As a result, subsequent sheets P are stacked upon the preceding sheet P, and a sheet bundle is formed. Having the conveyance roller pair 26 repeatedly switch back the sheets P or an incomplete sheet bundle makes it possible to buffer a plurality of sheets P regardless of the lengths of the sheets P. This operation will be called a "buffer operation" or a "stacking operation". The mechanisms involved in the buffer operation may be said to be the bundle forming section 60 and the buffer section 81. The buffer operation can enable the image forming apparatus 1 to continue forming images onto sheets P while the post-processing section 71 is executing post-processing. In other words, the overall productivity of the image forming system 100 is maintained by having the subsequent sheet P stand by in the buffer section 81 until the post-processing on the preceding sheet P is complete.

The sheet P conveyed from the conveyance roller pair 26 is fed through a conveyance roller pair 28 to kick-out rollers 29, and is then conveyed to the post-processing section 71. The post-processing section 71 has an upper guide 31 and a lower guide 32, and the sheet P is guided by the upper guide 31 and the lower guide 32.

A sheet sensor 38 is disposed in a conveyance section connecting the conveyance roller pair 28 with the kick-out rollers 29. Like the other sheet sensors, the sheet sensor 38 is a reflective photosensor that determines whether or not a sheet P is present. An alignment reference plate 39 is disposed at the part of the post-processing section 71 which is furthest downstream. When the leading end (the second end) of the sheet P butts against the alignment reference plate 39, the sheet bundle is aligned in the longitudinal direction.

A flexible pressing guide 56 is fixed to the upper guide 31. The pressing guide 56 makes contact with the sheet P within the post-processing section 71 at a predetermined pressure. A half-moon roller 33 is a paddle member for pushing the sheet P, which has passed the kick-out rollers 29, into the alignment reference plate 39. The half-moon roller 33 is rotatably supported by the upper guide 31 downstream from the pressing guide 56. After the following end (the first end) of the sheet P passes the sheet sensor 38, the half-moon roller 33 conveys the sheet P toward the alignment reference plate 39. The half-moon roller 33 may be called a "longitudinal alignment roller". The contact force of the half-moon roller 33 on the sheet P is adjusted to the extent that the half-moon roller 33 slips on the sheet P when the sheet P makes contact with the alignment reference plate 39. Additionally, a bundle pressing flag 30 is rotatably supported downstream from the kick-out rollers 29. The bundle pressing flag 30 keeps the following end of the sheet P from lifting such that the following end (the first end) of a sheet P loaded in the post-processing section 71 and the leading end (the second end) of the subsequent sheet P do not interfere with each other.

Once the alignment of a predetermined number of the sheets P (a sheet bundle) in the post-processing section 71 is complete, a stapler 50 executes a binding operation. When the binding operation is complete, a guide driving unit 35 moves a discharge guide 34 from a standby position toward the discharge roller pair 36. The discharge guide 34 pushes the sheet bundle toward the discharge roller pair 36 as a result. Note that the leading end and the following end of the sheet bundle are once again switched by the discharge guide 34. Once the leading end (the first end) of the sheet bundle reaches the discharge roller pair 36, the discharge guide 34 stops and then returns to the standby position again. The discharge roller pair 36 discharges the sheet bundle received from the discharge guide 34 to the lower tray 37.

An operation unit 5 has a display device that displays operation statuses of the image forming system 100, such as jams, malfunctions, and the like. The operation unit 5 instructs a user to replace consumable items, remove sheets P that have jammed, and the like.

Post-Processing Section

Figure 2A:
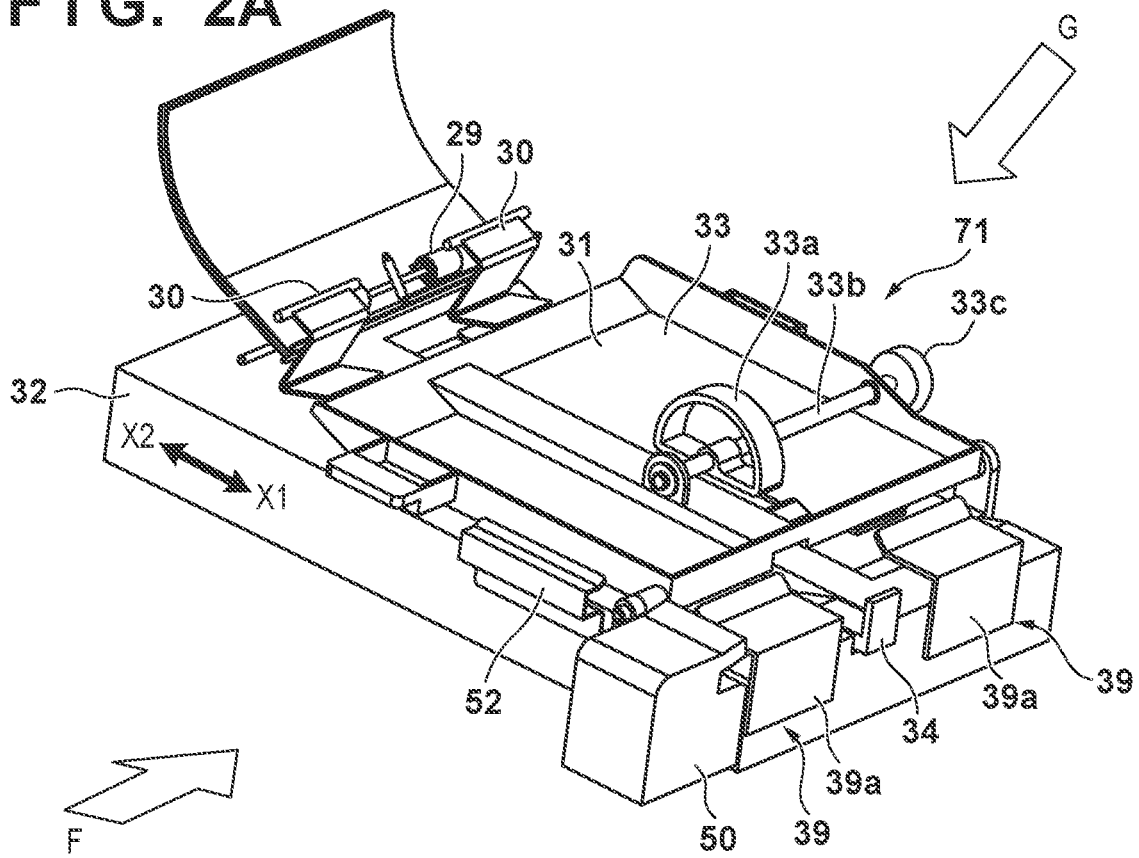
FIGS. 2A and 2B are perspective views of a post-processing section.
Figure 2B:
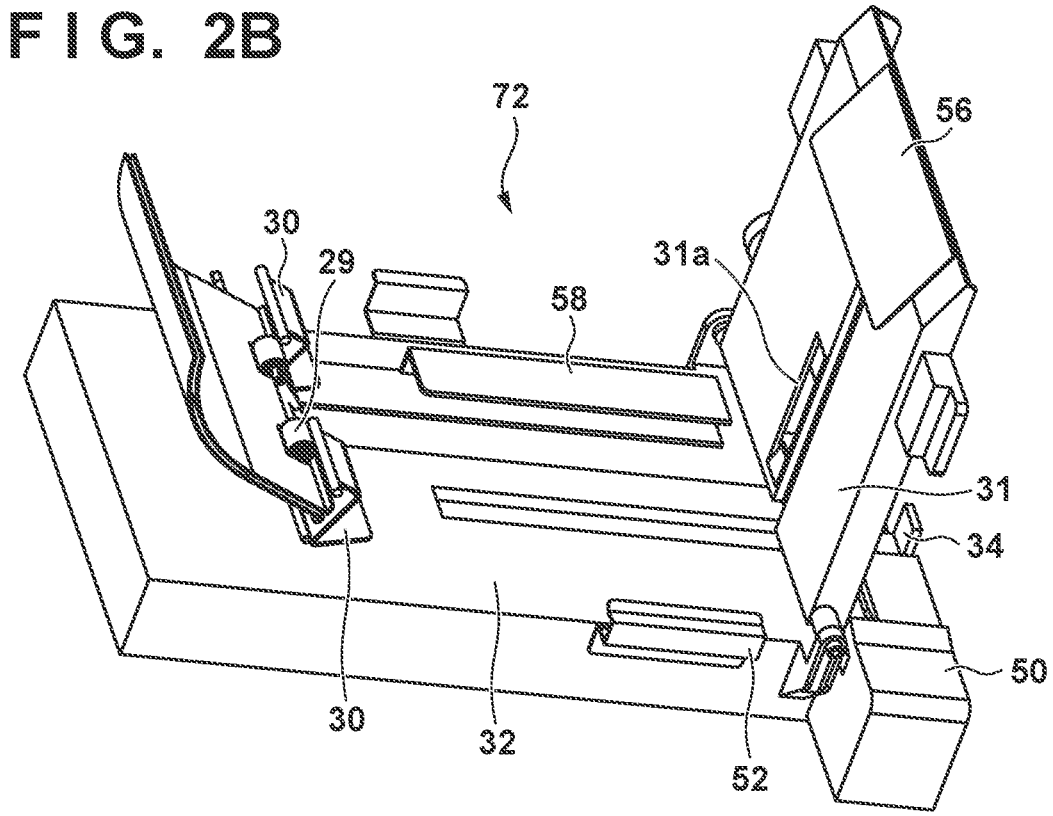

FIG. 2A is a perspective view of the post-processing section 71. FIG. 2B is a perspective view of the post-processing section 71 in a state where the upper guide 31 is open. The post-processing section 71 includes the stapler 50, the upper guide 31, the lower guide 32, the alignment reference plate 39, the half-moon roller 33, the discharge guide 34, and the like. The post-processing section 71 causes the stapler 50 to perform binding processing on the sheet bundle discharged from the conveyance path R2, and forms a bound sheet bundle.

The upper guide 31 and the lower guide 32 form an intermediate loading part 72 where sheets P to be processed are loaded. The lower guide 32 serves as a loading unit for the sheets P discharged from the kick-out rollers 29. The kick-out rollers 29 are conveyance rollers disposed furthest downstream in the conveyance path R2.

The bundle pressing flag 30 is provided downstream from the kick-out rollers 29 so as to be capable of pivoting. A lower face of the bundle pressing flag 30 is configured to press the following end part of a preceding sheet Pi discharged to the intermediate loading part 72 first ("i" is an index). As a result, the leading end of a subsequent sheet Pi+1 discharged by the kick-out rollers 29 after can pass above the following end of the preceding sheet Pi. In other words, the bundle pressing flag 30 prevents the sheets P from colliding with each other by moving the following end part of the sheet P discharged from the kick-out rollers 29 downward. According to FIG. 2B, two bundle pressing flags 30 are provided. This is to press both end parts, in the width direction, of a variety of sizes of sheets P that can be processed by the post-processing section 71.

The half-moon roller 33 is disposed above the lower guide 32. The half-moon roller 33 is formed from an elastic material such as synthetic rubber, an elastomer resin, or the like. The half-moon roller 33 has a roller part 33*a* having an outer circumferential surface adjusted to a predetermined coefficient of friction. The roller part 33*a* is supported by a shaft 33*b* which is rotatably supported by the upper guide 31. The roller part 33*a* is driven to rotate intermittently, one revolution at a time, by a drive transmission device including a gear unit 33*c*. The roller part 33*a* is noncircular when viewed from the axial direction of the shaft 33*b*. The half-moon roller 33 is in a standby state before the sheet P is discharged to the intermediate loading part 72. In the standby state, the half-moon roller 33 is held at a rotation angle at which the roller part 33*a* is not exposed from the upper guide 31. During a single revolution of the half-moon roller 33, the roller part 33*a* is temporarily exposed from an opening 31*a* provided in the upper guide 31. As a result, the roller part 33*a* makes contact with the top face of the sheet P loaded on the lower guide 32 and applies conveyance force to the sheet P. The contact pressure of the half-moon roller 33 against the sheet P is adjusted such that the half-moon roller 33 slips when the sheet P butts against the alignment reference plate 39.

The pressing guide 56, which is a flexible sheet member, is disposed in the intermediate loading part 72. The pressing guide 56 is disposed so as to make contact with the lower guide 32, and presses the top face of the sheet P loaded in the intermediate loading part 72 at a predetermined pressure.

The alignment reference plate 39 is provided downstream from the half-moon roller 33 in a discharge direction in which the sheet P is discharged by the kick-out rollers 29. The alignment reference plate 39 has a reference wall 39*a* that protrudes upward from the top face of the lower guide 32, as a regulating part that makes contact with the end part of the sheet P. As illustrated in FIG. 2A, two alignment reference plates 39 may be provided. The alignment reference plates 39 are provided one on each side in the direction orthogonal to the discharge direction of the sheets P (the width direction of the sheets P).

In the following, the direction in which the sheet P discharged by the kick-out rollers 29 moves toward the alignment reference plate 39 in the post-processing section 71 will be defined as a "longitudinal alignment direction X1". The longitudinal alignment direction X1 is a direction parallel to a forward feed direction of the sheets P in the conveyance path R2, and is a direction in which the half-moon roller 33 moves the sheets P toward the alignment reference plate 39. The direction opposite to the longitudinal alignment direction X1, in which the sheet bundles are discharged from the post-processing section 71, is defined as a "bundle discharge direction X2".

When a plurality of sheets P are loaded in the intermediate loading part 72, the sheets P are aligned in both the longitudinal alignment direction X1 and the width direction. The alignment in the longitudinal alignment direction X1 is achieved by the half-moon roller 33 and the alignment reference plate 39. The alignment in the lateral direction is achieved by a lateral alignment jogger 58 causing the sheets P to butt against a lateral alignment reference plate 52.

The stapler 50 performs binding processing at a predetermined position of the sheet bundle constituted by a plurality of sheets P. The stapler 50 is provided on the same side as the lateral alignment reference plate 52 in the width direction. The stapler 50 can furthermore move in the longitudinal alignment direction X1 and the bundle discharge direction X2.

The lower guide 32 has a width sufficient to load legal-sized sheets P conveyed through long-side feeding. "Long-side feeding" refers to conveying the sheets P such that the direction of the long side of the sheets P is parallel to the longitudinal alignment direction X1.

The stapler 50 is capable of performing corner binding and long side binding. "Corner binding" refers to binding a corner part of the sheet bundle. "Long side binding" refers to the stapler 50 binding the sheet bundle at a plurality of positions along the long side thereof while moving relative to the sheet bundle.

Sheet Bundle Generation

A jam will occur if a subsequent sheet P is conveyed to the post-processing section 71 before a sheet bundle is discharged from the post-processing section 71. It is therefore necessary for the post-processing apparatus 4 to cause the subsequent sheet P to stand by until the preceding sheet bundle is discharged from the post-processing section 71. The post-processing apparatus 4 causes a subsequent plurality of sheets P to wait, in a stacked state, in the conveyance path R2 and the conveyance path R3. When stacking a plurality of sheets P, the preceding sheet Pi and the subsequent sheet Pi+1 are stacked such that the sheet Pi+1 is shifted relative to the sheet Pi in the conveyance direction. This assists the alignment of the sheet Pi and the sheet Pi+1 in the longitudinal direction by the half-moon roller 33.

Figure 3A:
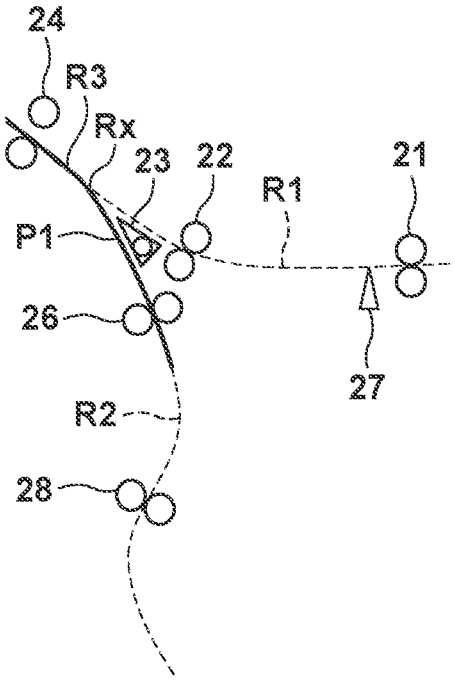
FIGS. 3A to 3D are diagrams illustrating a method for generating a sheet bundle.

FIGS. 3A to 3D illustrate a method for generating a sheet bundle. As illustrated in FIG. 3A, when a sheet P1 undergoes switch-back conveyance by the conveyance roller pair 24 and reaches the conveyance roller pair 26, the conveyance roller pair 24 and the conveyance roller pair 26 stop. At this time, the leading end of the sheet P1 stops at a position downstream from the conveyance roller pair 26 by a predetermined distance. The post-processing apparatus 4 then causes the upper roller and the lower roller constituting the conveyance roller pair 24 to separate.

Figure 3B:
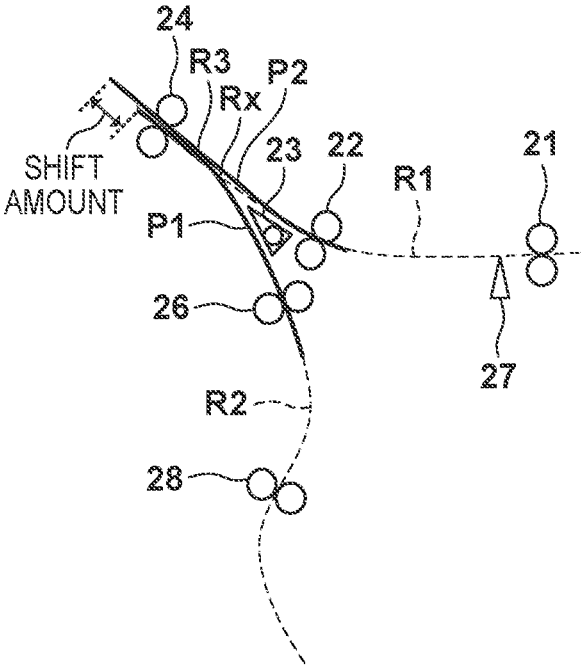

As illustrated in FIG. 3B, after a predetermined length of time passes following the sheet sensor 27 detecting the following end of a sheet P2, the upper roller and the lower roller of the conveyance roller pair 24 make contact, the conveyance roller pair 24 and the conveyance roller pair 26 rotate, and the sheet P2 is conveyed in the direction of the upper tray 25. The predetermined length of time depends on the shift amount of the sheet P2 relative to the sheet P1. Increasing the predetermined length of time increases the shift amount, whereas reducing the predetermined length of time reduces the shift amount.

Figure 3C:
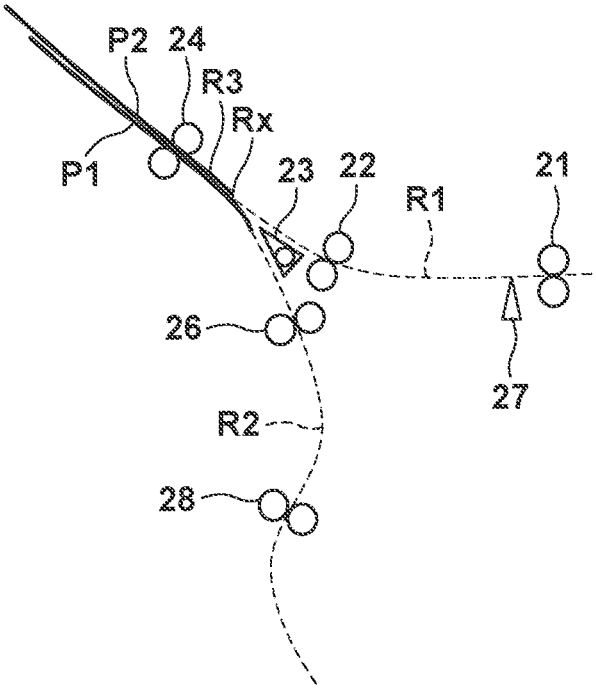

As illustrated in FIG. 3C, when the following end of the sheet P2 reaches the branch point Rx, the rotation direction of the conveyance roller pair 24 and the conveyance roller pair 26 reverses, and the sheets P1 and P2 are conveyed in the direction of the post-processing section 71. In other words, the sheets P1 and P2 are conveyed to the conveyance path R2.

Figure 3D:
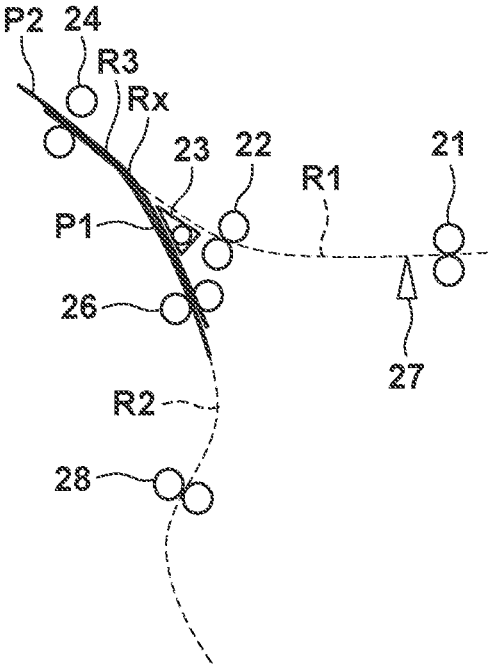

As illustrated in FIG. 3D, when the sheet P2 reaches the conveyance roller pair 26, the conveyance roller pair 24 and the conveyance roller pair 26 stop. The conveyance roller pair 24 moves from the contact state to the separated state.

Although a sheet bundle constituted by two sheets P has been described here, this is merely an example. A sheet bundle constituted by three or more sheets P is generated by repeating the stacking operations (bundle generation operations). Note that the present embodiment assumes that a sheet bundle having a maximum of four sheets can be generated. As such, in a job in which 20 sheets P are conveyed consecutively to the post-processing section 71, the generation of a sheet bundle constituted by four sheets P is repeated five times.

In the present embodiment, the shift amount, in the conveyance direction, between the adjacent sheet Pi and the sheet Pi+1 constituting a sheet bundle, is determined according to a delay time (delay distance) of the subsequent sheet P or a delay time (delay distance) of the preceding sheet bundle. This ensures a sufficient conveyance interval between the preceding sheet P (or sheet bundle) and the subsequent sheet P (or sheet bundle), and makes it easier to convey the sheets P normally. Note that the term "delay amount" will be introduced as a concept that can include both the delay time and the delay distance.

Conveyance Delay Determination

The post-processing apparatus 4 obtains a delay amount of the sheet P, caused by roller slippage or the like, for the conveyance of sheets from the image forming apparatus 1 to the buffer section 81. For example, the post-processing apparatus 4 uses a timer or a counter to measure the length of time from when the report signal S1 is received to when the leading end of the sheet P is detected by the sheet sensor 27. A conveyance speed V of the sheet P is assumed to be known here. Accordingly, the post-processing apparatus 4 obtains a delay amount T_delay by obtaining an ideal conveyance time from the conveyance speed V and the distance L_buff1, and then subtracting the ideal conveyance time from the measured conveyance time.

$$T_delay = T_measure - T_ideal \quad \text{EQ1}$$

Here, T_ideal represents the ideal conveyance time. T_Measure represents the measured conveyance time.

The unit of the delay amount T_delay need not be time. For example, the delay amount T_delay may be obtained based on a count value of drive pulses from a motor that drives the entrance rollers 21. Although the delay amount for the leading end of the sheet P is obtained here, a delay amount for the following end of the sheet P can also be obtained using the same method.

Longitudinal Alignment of Sheet Bundle

FIGS. 4A to 4D illustrate a sheet bundle W constituted by three sheets P1, P2, and P3 undergoing longitudinal alignment. The sheet P1 is located at the bottom. The sheet P2 is located in the middle. The sheet P3 is located at the top.

Figure 4A:
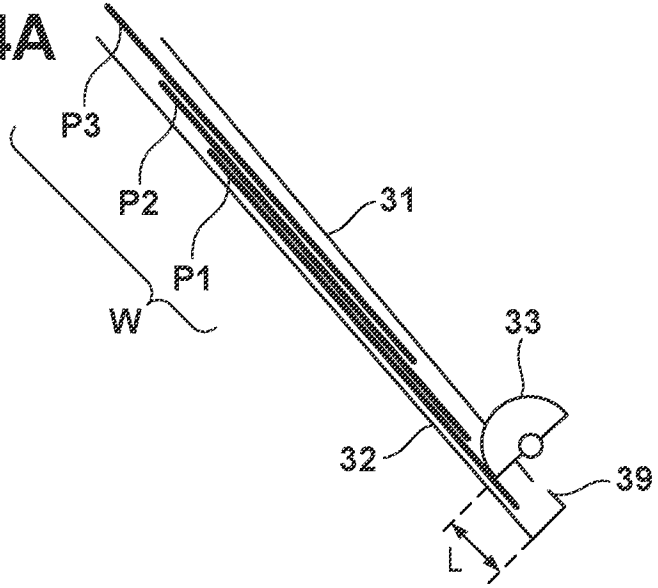
FIGS. 4A to 4D are diagrams illustrating longitudinal alignment operations for a sheet bundle.
Figure 4B:
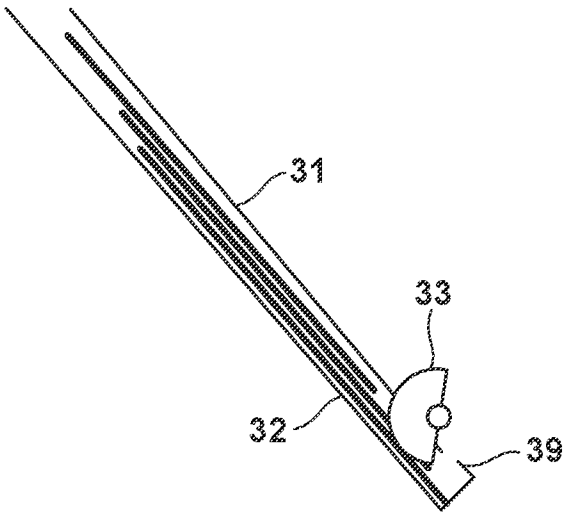

When the sheet bundle W is fed into the post-processing section 71, the half-moon roller 33 rotates, and the longitudinal alignment begins. As illustrated in FIGS. 4A and 4B, when the longitudinal alignment begins, the half-moon roller 33 makes contact with the sheet P1, and causes the sheet P1 to butt against the alignment reference plate 39. Because there is the shift amount between the sheet P1 and the sheet P2, the half-moon roller 33 can make contact only with the sheet P1.

Figure 4C:
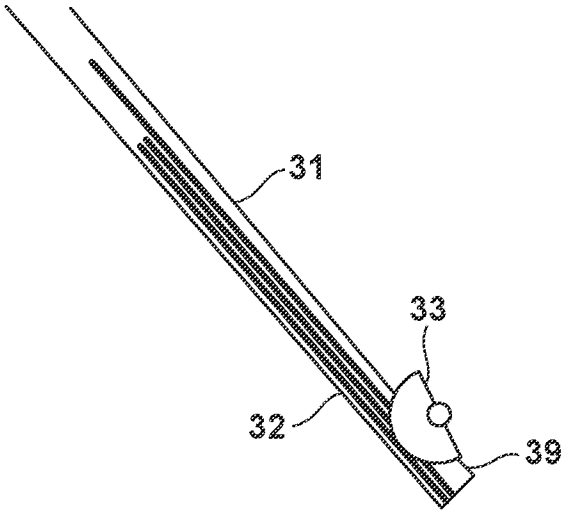
Figure 4D:
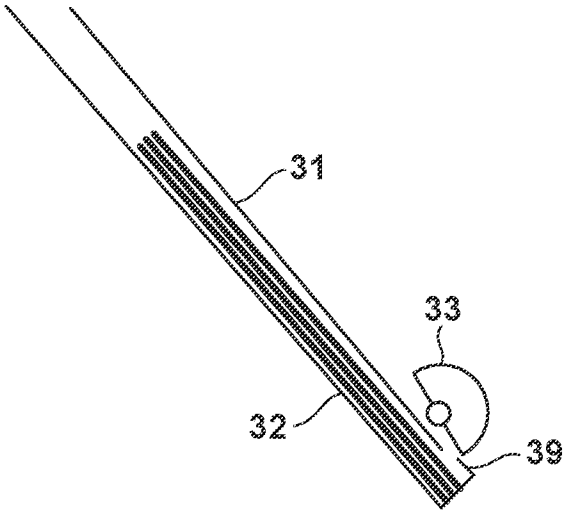

As illustrated in FIG. 4C, the half-moon roller 33 makes contact with the sheet P2, and the sheet P2 butts against the alignment reference plate 39. As illustrated in FIG. 4D, the half-moon roller 33 makes contact with the sheet P3, and the sheet P3 butts against the alignment reference plate 39. This completes the longitudinal alignment of the sheet bundle W.

The plurality of sheets P1 to P3 constituting the sheet bundle W are shifted from each other in the conveyance direction. The leading end of the sheet P1 is the furthest forward, and the leading end of the sheet P3 is the furthest to the rear. As such, the half-moon roller 33 can make contact with the sheets P1 to P3 in that order as time passes, and each of the sheets P1 to P3 can butt against the alignment reference plate 39. The sheet bundle W can therefore be aligned longitudinally at a high level of precision.

The shift amount between two adjacent sheets may be determined by adding a predetermined margin to a distance L between the position where the half-moon roller 33 makes contact with the sheet P and the position of the alignment reference plate 39. The margin may include a distance necessary for the longitudinal alignment. The margin may further include a distance determined taking into account friction between the sheets and the like. The distance L is 20 mm, for example.

Here, a larger amount of friction acts on the plurality of sheets P as the surface area of the sheets P increases. A large amount of friction acts on the plurality of sheets P when the sheets P have a surface finish (e.g., glossy paper or embossed paper). In this case, it is necessary for the post-processing section 71 to have advanced alignment capabilities. In other words, the shift amount is set to be sufficiently long relative to the distance L. If the alignment capabilities required for the post-processing section 71 are low, the shift amount can be set to be relatively short.

In the present embodiment, the shift amount is determined according to the alignment capabilities. The shift amount may furthermore be determined according to both the alignment capabilities and the delay amount T_delay. For example, in the case of a type of sheet P which requires low alignment capabilities, the shift amount may be determined based on the delay amount T_delay. On the other hand, in the case of a type of sheet P which requires high alignment capabilities, the shift amount may be set to a fixed value independent of the delay amount T_delay.

FIG. 5A is a table for determining the shift amount based on the required alignment capabilities and the delay amount. Note that the delay amount is converted to a distance. In this example, when the required alignment capabilities are relatively low and the delay amount T_delay is at least 5 mm, the shift amount is set to 25 mm. When the required alignment capabilities are relatively low and the delay amount T_delay is less than 5 mm, the shift amount is set to 30 mm. When the required alignment capabilities are relatively high, the shift amount is set to 30 mm independent of the delay amount. Although the shift amount is divided into two stages based on a single threshold (5 mm) in FIG. 5A, this is merely an example. Providing n thresholds makes it possible to select n+1 shift amounts.

The required alignment capabilities are determined according to the type of the sheet P (e.g., the surface area, the basis weight, and surface finishing). These are merely examples, however. The post-processing apparatus 4 may determine the required alignment capabilities based on conditions of the environment in which the post-processing apparatus 4 is installed (e.g., temperature or humidity).

In FIG. 5A, the shift amount is set to 30 mm uniformly when the required alignment capabilities are high, but this is merely an example. When the required alignment capabilities are high, the shift amount (e.g., 30 mm or 28 mm) may be set according to the delay amount. Note that 30 mm or 28 mm are shift amounts making it possible to ensure the minimum conveyance interval required for longitudinal alignment.

Control System (Controller)

Figure 6:
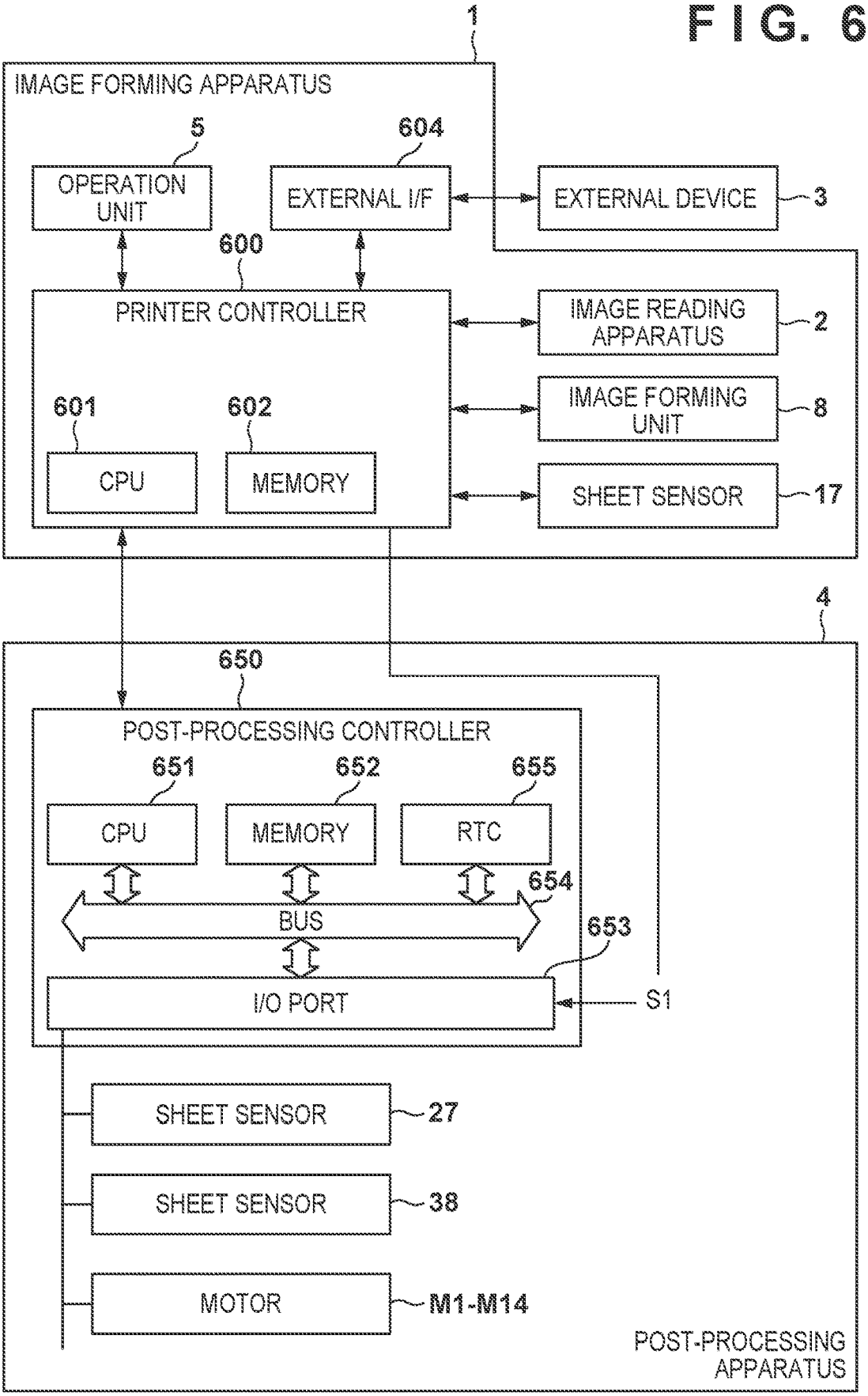
FIG. 6 is a block diagram illustrating a controller.

FIG. 6 illustrates the control system of the image forming system 100. A printer controller 600 is provided in the image forming apparatus 1. A post-processing controller 650 is provided in the post-processing apparatus 4. The printer controller 600 and the post-processing controller 650 are connected to each other by a communication interface, and cooperatively control the image forming system 100.

The printer controller 600 includes a CPU 601 and a memory 602. "CPU" is an acronym for "central processing unit". The CPU 601 comprehensively controls the image forming apparatus 1 by executing programs stored in the memory 602. For example, the CPU 601 causes the image forming unit 8 to form images, and causes the image reading apparatus 2 to read images. The memory 602 includes a non-volatile storage medium such as read-only memory (ROM) and a volatile storage medium such as random access memory (RAM). The memory 602 serves as a storage location for programs and data, as well as a work space for the CPU 601 to execute programs. The memory 602 is an example of a non-transitory storage medium in which is stored a program for controlling the image forming apparatus 1.

The printer controller 600 is connected to an external device 3 (e.g., a personal computer, a smartphone, or a tablet computer) by an external I/F 104. Note that "I/F" is an abbreviation for "interface". The printer controller 600 accepts commands to execute image formation jobs and the like from the external device 3. The printer controller 600 is connected to the operation unit 5, which is a user interface of the image forming system 100. The operation unit 5 includes a liquid crystal display device that presents information to the user, and input devices including physical buttons, a touch sensor, and the like that accept input operations made by the user. By communicating with the operation unit 5, the printer controller 600 controls content displayed by the display device and receives information input through the input devices. The CPU 601 generates the report signal S1 based on the result of the detection by the sheet sensor 17, and transmits the report signal S1 to the post-processing controller 650. The report signal S1 may be called a "notification signal" or a "detection signal".

The post-processing controller 650 includes a CPU 651, a memory 652, and an I/O port 653. The CPU 651 comprehensively controls the post-processing apparatus 4 by reading out and executing programs stored in the memory 652. The memory 652 includes a non-volatile storage medium such as read-only memory (ROM) and a volatile storage medium such as random access memory (RAM). The memory 652 serves as a storage location for programs and data, as well as a work space for the CPU 651 to execute programs. The memory 652 is an example of a non-transitory storage medium in which is stored a program for controlling the post-processing apparatus 4. The CPU 651 and the memory 652 communicate over a bus 654. The CPU 651 is furthermore connected to the I/O port 653 by the bus 654. The I/O port 653 receives the report signal S1, receives detection signals from the sheet sensors 27 and 38, outputs control signals to motors M1 to M14, and the like. The motors M1 to M14 are illustrated as including one or more drive circuits that drive motors based on control signals. The CPU 651 may obtain time information from an RTC 655. "RTC" is an acronym for "real-time clock".

The plurality of functions of the printer controller 600 and the post-processing controller 650 are implemented by the CPUs 601 and 651, respectively. However, some or all of the plurality of functions may be implemented in one or more independent hardware circuits such as ASICs or the like, or implemented as program modules.

The motor M1 rotationally drives the entrance rollers 21. The motor M2 rotationally drives the conveyance roller pair 22. The motor M3 rotationally drives the conveyance roller pair 24. The motor M4 shifts the conveyance roller pair 24 to the contact state by rotating in the CW direction, and shifts the conveyance roller pair 24 to the separated state by rotating in the CCW direction. "CW" stands for "clockwise". "CCW" stands for "counterclockwise". These rotation directions are merely examples. The motor M5 moves the conveyance roller pair 24 in a first direction orthogonal to the conveyance direction by rotating in the CW direction, and moves the conveyance roller pair 24 in a second direction orthogonal to the conveyance direction by rotating in the CCW direction. The motor M6 rotationally drives the conveyance roller pair 26. The motor M7 rotationally drives the kick-out rollers 29. The motor M8 drives the half-moon roller 33 intermittently, one revolution at a time. The motor M9 moves the lateral alignment jogger 58 in the width direction. The motor M10 moves the stapler 50 in the longitudinal alignment direction X1 and the bundle discharge direction X2. The motor M11 causes the stapler 50 to bind the sheet bundle W. The motor M12 drives the guide driving unit 35 to slide the discharge guide 34. When the motor M12 rotates in the CW direction, the discharge guide 34 moves in the longitudinal alignment direction X1. When the motor M12 rotates in the CCW direction, the discharge guide 34 moves in the bundle discharge direction X2. The motor M13 rotationally drives the discharge roller pair 36. The motor M14 shifts the discharge roller pair 36 to the contact state by rotating in the CW direction, and shifts the discharge roller pair 36 to the separated state by rotating in the CCW direction.

CPU Functions

Figure 7:
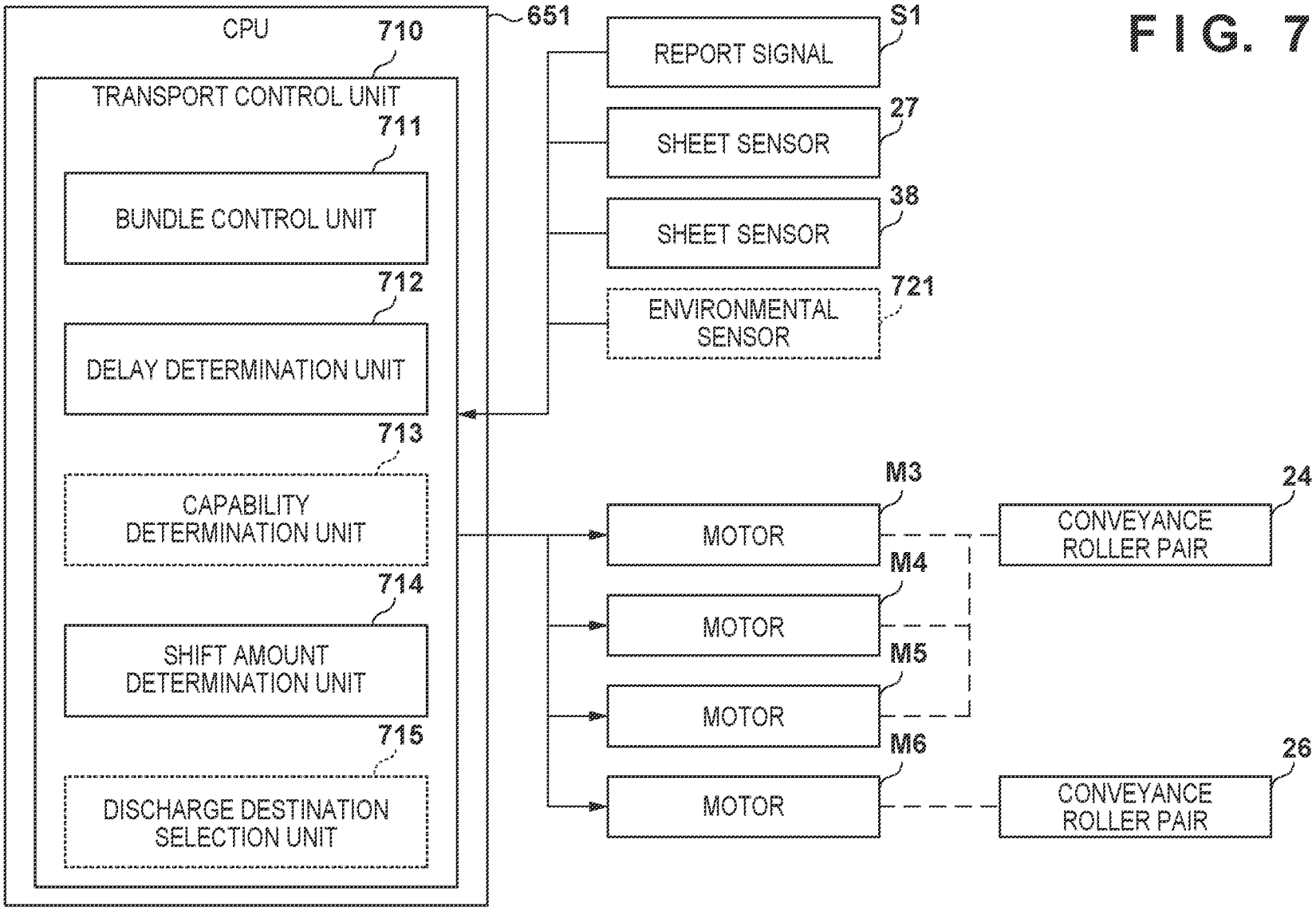
FIG. 7 is a diagram illustrating functions of a CPU.
Figure 8:
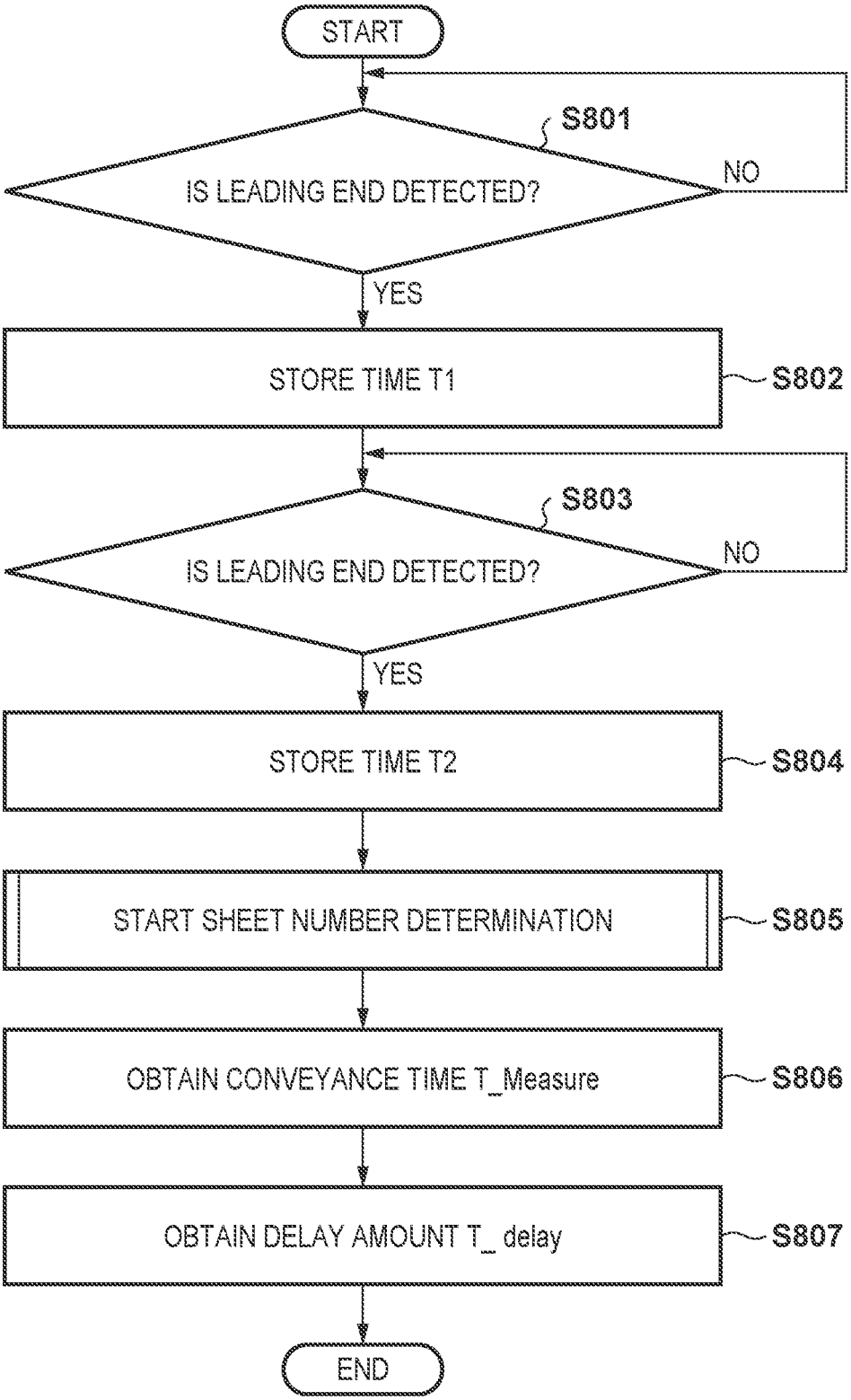
FIG. 8 is a flowchart illustrating a delay amount measurement method.

FIG. 7 illustrates functions which are realized by the CPU 651 executing a control program and are involved in the generation of a sheet bundle W. The post-processing controller 650 has a conveyance control unit 710, a bundle control unit 711, a delay determination unit 712, a shift amount determination unit 714, and the like.

The conveyance control unit 710 controls the conveyance of sheets P by driving the motors M1 to M14 based on detection signals from the sheet sensors 27 and 38 and the report signal S1 from the image forming apparatus 1. The conveyance control unit 710 controls the post-processing section 71 based on post-processing instructions transmitted from the printer controller 600. The post-processing instructions may include sheet number information indicating the total number of sheets P constituting the sheet bundle W, discharge destination information indicating the discharge destination (conveyance destination) of the sheets P, and the like.

The delay determination unit 712 determines the delay amount for the sheet P conveyed from the image forming apparatus 1 to the post-processing apparatus 4 based on the report signal S1 and the detection signal from the sheet sensor 27. Additionally, based on the detection signal from the sheet sensor 27, the delay determination unit 712 determines the delay amount for the sheet bundle W conveyed from the buffer section 81 to the post-processing section 71. The shift amount determination unit 714 determines the shift amounts among the plurality of sheets constituting the sheet bundle W based on the delay amounts output from the delay determination unit 712, and sets the shift amount in the bundle control unit 711.

Note that a capability determination unit 713 is optional, and may determine the alignment capabilities required to successfully generate the sheet bundle W based on environmental conditions (e.g., temperature, humidity) obtained by an environmental sensor 721. The capability determination unit 713 may determine the alignment capabilities required to successfully generate a sheet bundle based on type information (e.g., the basis weight, size, and surface finish of the sheet) input from the operation unit 5 or the external device 3. The shift amount determination unit 714 may determine the shift amount corresponding to the combination of alignment capabilities and the delay amount by referring to a table stored in the memory 652 based on the alignment capabilities and the delay amount.

The bundle control unit 711 controls the generation of the sheet bundle W by driving the motor M3, the motor M4, the motor M6, and the like based on the detection signal from the sheet sensor 27 and the shift amount determined by the shift amount determination unit 714. When the sheet sensor 27 detects the following end of the sheet P, the bundle control unit 711 drives the motor M4 and brings the conveyance roller pair 24 into contact after a predetermined length of time corresponding to the shift amount has passed. Furthermore, the motor M3 is rotated in reverse, and the motor M6 is rotated in reverse as well. As a result, the shift amount between a preceding sheet bundle Wi and a subsequent sheet bundle Wi+1 becomes the shift amount determined by the shift amount determination unit 714.

A discharge destination selection unit 715 is optional. If reducing the shift amount alone is not enough to ensure a sufficient interval between the sheets P, the discharge destination selection unit 715 changes the discharge destination of the sheets P. As a result, the sheet P is discharged to a different discharge destination than the discharge destination specified by the image forming apparatus 1. This prevents jams from occurring.

Flowcharts

FIGS. 8 to 11 illustrate a bundle generation method executed by the CPU 651 according to a program. When the printer controller 600 supplies a sheet P from the paper feed device 6 and starts printing according to a print job, the CPU 651 executes the following processing for each sheet P.

In step S801, the CPU 651 (the delay determination unit 712) determines whether the leading end of the sheet P has been detected by the sheet sensor 17. For example, the CPU 651 may determine whether the leading end of the sheet P is detected based on the report signal S1. The report signal S1 may change from low level to high level when the leading end of the sheet P is detected, for example. When the leading end of the sheet P is detected by the sheet sensor 17, the CPU 651 moves the sequence to step S802.

In step S802, the CPU 651 (the delay determination unit 712) obtains, from the RTC 655, a time T1 at which the leading end of the sheet P is detected by the sheet sensor 27, and stores the time T1 in the memory 652.

In step S803, the CPU 651 (the delay determination unit 712) determines whether the leading end of the sheet P has been detected by the sheet sensor 27. When the leading end of the sheet P is detected by the sheet sensor 27, the CPU 651 moves the sequence to step S804.

In step S804, the CPU 651 (the delay determination unit 712) obtains, from the RTC 655, a time T2 at which the leading end of the sheet P is detected by the sheet sensor 27, and stores the time T2 in the memory 652.

In step S805, the CPU 651 (the bundle control unit 711) starts sheet number determination. The sheet number determination will be described in detail later with reference to FIG. 9.

In step S806, the CPU 651 (the delay determination unit 712) obtains a conveyance time T_measure based on times T1 and T2.

$$T_measure = T2 - T1 \quad \text{EQ2}$$

In step S807, the CPU 651 (the delay determination unit 712) calculates the delay amount T_delay based on the conveyance time T_measure. Equation EQ1 may be used here.

Figure 9:
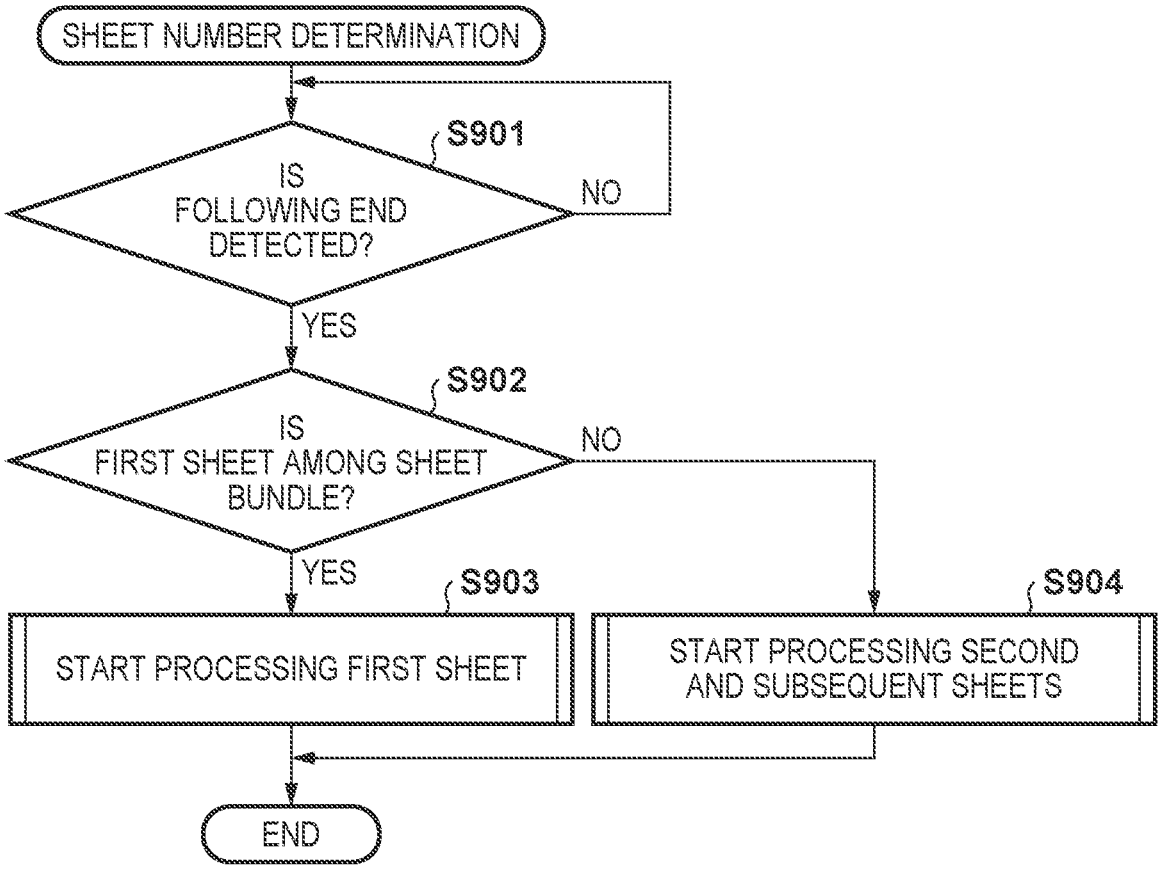
FIG. 9 is a flowchart illustrating a method for determining a number of a sheet constituting a sheet bundle.

FIG. 9 illustrates the details of the sheet number determination of step S805. In step S901, the CPU 651 (the bundle control unit 711) determines whether the following end of the sheet P has been detected by the sheet sensor 27. When the following end of the sheet P is detected by the sheet sensor 27, the CPU 651 moves the sequence to step S902.

In step S902, the CPU 651 (the bundle control unit 711) determines whether the sheet P for which the following end has been detected by the sheet sensor 27 is the first sheet among a predetermined number of sheets P constituting the sheet bundle W. The CPU 651 is notified by the printer controller 600 of the total number of sheets that constitute the sheet bundle W (the predetermined number of sheets). The CPU 651 manages the sheets P by assigning a number to the sheet P each time the sheet sensor 27 detects the leading end of the sheet P. Therefore, a remainder obtained by dividing the number of the sheet P by the predetermined number of sheets indicates the order of those sheets in the sheet bundle W. If the detected sheet P is the first sheet, the CPU 651 moves the sequence to step S903. In step S903, the CPU 651 (the bundle control unit 711) starts processing the first sheet. The processing of the first sheet will be described in detail later with reference to FIG. 10. On the other hand, if the detected sheet P is the second or a subsequent sheet, the CPU 651 moves the sequence to step S904. In step S904, the CPU 651 (the bundle control unit 711) starts processing the second and subsequent sheets. The processing of the second and subsequent sheets will be described in detail later with reference to FIG. 11.

Figure 10:
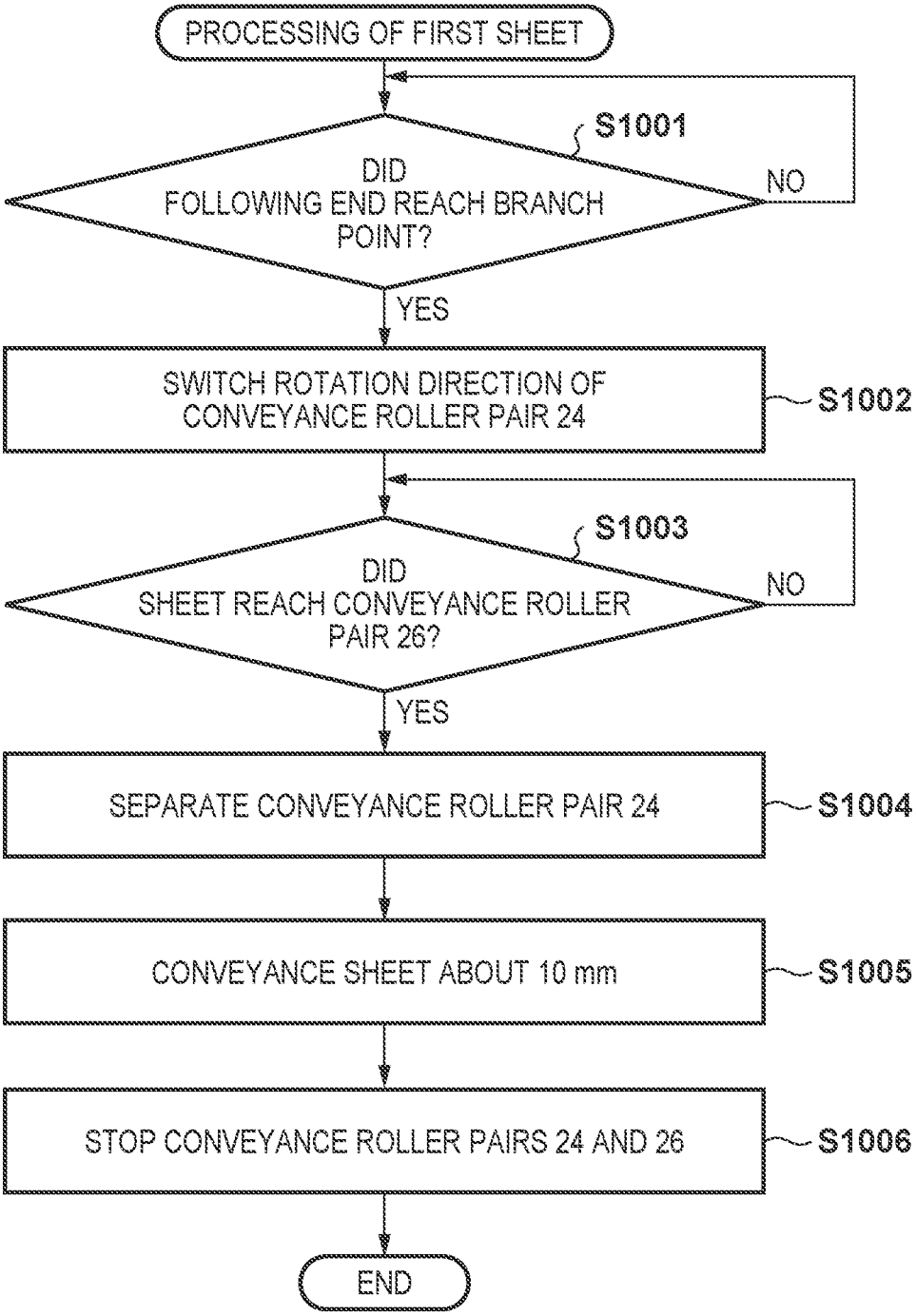
FIG. 10 is a flowchart illustrating processing applied to a first sheet.

FIG. 10 illustrates the processing of the first sheet in the sheet bundle W. In step S1001, the CPU 651 (the bundle control unit 711) determines whether the following end of the sheet P has reached the branch point Rx. For example, the CPU 651 determines whether a predetermined length of time Tm has elapsed from the timing at which the following end of the sheet P was detected by the sheet sensor 27. The predetermined length of time Tm is obtained by dividing the conveyance distance from the sheet sensor 27 to the branch point Rx by the conveyance speed V. When the following end of the sheet P reaches the branch point Rx, the conveyance direction of the sheet P can be reversed and the sheet P can be fed to the conveyance path P2. The CPU 651 therefore moves the sequence to step S1002.

In step S1002, the CPU 651 (the bundle control unit 711) switches the rotation direction of the conveyance roller pair 24. As a result, the sheet P drawn into the conveyance path R3 of the buffer section 81 is fed to the conveyance path R2.

In step S1003, the CPU 651 (the bundle control unit 711) determines whether the sheet P has reached the conveyance roller pair 26. As described above, the CPU 651 knows the current conveyance position of the sheet P based on an elapsed time from the timing at which the sheet sensor 27 detected the following end. When the elapsed time reaches the predetermined length of time Tm, the CPU 651 determines that the sheet P has reached the conveyance roller pair 26 and moves the sequence to step S1004.

In step S1004, the CPU 651 (the bundle control unit 711) drives the motor M4 to separate the conveyance roller pair 24. In step S1005, the CPU 651 (the bundle control unit 711) conveys the sheet P about 10 mm from the conveyance roller pair 26. In step S1006, the CPU 651 (the bundle control unit 711) stops the conveyance roller pairs 24 and 26. As a result, the first sheet P1 in the sheet bundle W stops at a position about 10 mm past the conveyance roller pair 26. In other words, the leading end of the first sheet P1 is at a position about 10 mm past the conveyance roller pair 26.

In steps S1001, S1003, and S1005, the position of the sheet P is determined based on the elapsed time from the timing at which the sheet sensor 27 detected the sheet P, but this is merely an example. The CPU 651 may count the drive pulses of the motors M2, M3, and M6 and determine the conveyance position of the sheet P based on the sum of the count values. Alternatively, a sheet sensor (not shown) may be disposed in a position about 10 mm past the conveyance roller pair 26. Based on a detection result from this sheet sensor (not shown), the CPU 651 may detect that the leading end of the first sheet P1 is located about 10 mm past the conveyance roller pair 26. Similarly, a sheet sensor may be disposed at the branch point Rx. This sheet sensor may detect that the following end of the sheet P has reached the branch point Rx. Similarly, a sheet sensor for detecting that the sheet P has reached the conveyance roller pair 26 may be disposed upstream from the conveyance roller pair 26.

Figure 11:
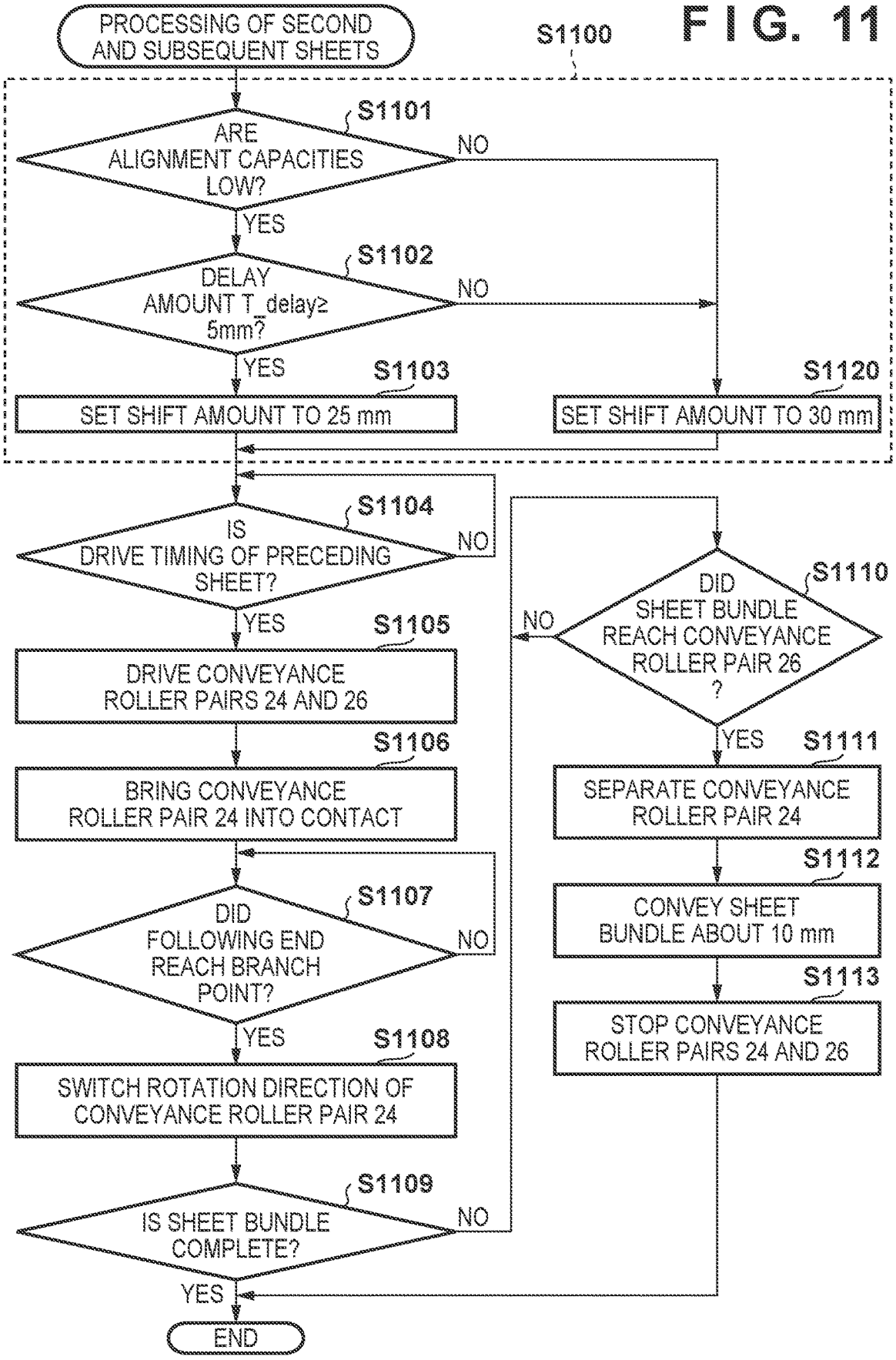
FIG. 11 is a flowchart illustrating processing applied to second and subsequent sheets.

FIG. 11 illustrates the processing of the second and subsequent sheets in the sheet bundle W (processing corresponding to step S904). Step S1100 is processing for determining the shift amount. As an example, it is assumed here that the shift amount is determined based on the alignment capabilities and the delay amount.

In step S1101, the CPU 651 (the capability determination unit 713) determines whether the alignment capabilities required for the sheet P are low. The alignment capabilities are determined based on the type information of the sheet P (e.g., the surface area, surface finish, and basis weight) or the surrounding environmental conditions, as described above. The CPU 651 may calculate the alignment capabilities based on the type information of the sheet P and the environmental conditions, and determine whether the alignment capabilities are lower than a threshold. The calculation equations, calculation tables, or calculation modules for the alignment capabilities are assumed to be stored in the ROM of the memory 652 in advance. If the alignment capabilities are high, the CPU 651 moves the sequence to step S1120. In step S1120, the CPU 651 (the shift amount determination unit 714) sets the shift amount to a first predetermined value (e.g., 30 mm), and then moves the sequence to step S1104. On the other hand, if the alignment capabilities are low, the CPU 651 moves the sequence to step S1102.

In step S1102, the CPU 651 (the delay determination unit 712) determines whether the delay amount T_delay of the sheet P is at least a threshold (e.g., 5 mm). If the delay amount T_delay is at least 5 mm, the CPU 651 moves the sequence to step S1103. On the other hand, if the delay amount T_delay is less than 5 mm, the CPU 651 moves the sequence to step S1120.

In step S1103, the CPU 651 (the shift amount determination unit 714) sets the shift amount to a second predetermined value (e.g., 25 mm), which is lower than the first predetermined value (e.g., 30 mm), and then moves the sequence to step S1104.

In step S1104, the CPU 651 (the bundle control unit 711) obtains the time from the RTC 655 and determines whether that time is a drive timing of the preceding sheet Pi. The "drive timing of the preceding sheet Pi" refers to the timing for pulling the preceding sheet Pi, which is standing by across the conveyance path R2 and the conveyance path R3, back to the buffer section 81. This timing is determined according to the shift amount. In other words, this timing is the timing at which a predetermined length of time has elapsed after the following end of the subsequent sheet Pi+1 was detected by the sheet sensor 27. The predetermined length of time is a length of time corresponding to the shift amount. When the drive timing for the preceding sheet Pi arrives, the CPU 651 moves the sequence to step S1105.

In step S1105, the CPU 651 (the bundle control unit 711) drives the conveyance roller pairs 24 and 26. The conveyance roller pair 24 rotates in the direction that pulls the preceding sheet Pi and the subsequent sheet Pi+1 into the buffer section 81. The conveyance roller pair 26 rotates in the direction that feeds the preceding sheet Pi into the buffer section 81.

In step S1106, the CPU 651 (the bundle control unit 711) brings the conveyance roller pair 24 into contact. In step S1107, the CPU 651 (the bundle control unit 711) determines whether the following end of the subsequent sheet Pi+1 has reached the branch point Rx. When the following end of the subsequent sheet Pi+1 reaches the branch point Rx, the CPU 651 moves the sequence to step S1108.

In step S1108, the CPU 651 (the bundle control unit 711) switches the rotation direction of the conveyance roller pair 24. As a result, a sheet bundle W constituted by the preceding sheet Pi and the subsequent sheet Pi+1 is fed into the conveyance path R2. Note that the sheet bundle W may be constituted by preceding sheets Pi−1 and Pi, and the subsequent sheet Pi+1. Furthermore, the sheet bundle W may be constituted by preceding sheets Pi−2, Pi−1, and Pi, and the subsequent sheet Pi+1.

In step S1109, the CPU 651 (the bundle control unit 711) determines whether the sheet bundle W is complete. The CPU 651 manages the total number of sheets P constituting the sheet bundle W (the predetermined number of sheets), and the number of each sheet P. When the remainder obtained by dividing the number of the sheet P by the predetermined number of sheets is zero, the CPU 651 determines that the sheet bundle W is complete, and the present processing ends. If the remainder obtained by dividing the number of the sheet P by the predetermined number of sheets is not zero, the CPU 651 determines that the sheet bundle W is incomplete, and moves the sequence to step S1110. The sheet bundle W being incomplete means that a subsequent sheet Pi+2, which is to be added to the sheet bundle W, is present in the buffer section 81.

In step S1110, the CPU 651 (the bundle control unit 711) determines whether the sheet bundle W has reached the conveyance roller pair 26. The determination method used here is the same as that in step S1003. When the sheet bundle W reaches the conveyance roller pair 26, the CPU 651 moves the sequence to step S1111.

In step S1111, the CPU 651 (the bundle control unit 711) drives the motor M4 to separate the conveyance roller pair 24. In step S1112, the CPU 651 drives the motors M3 and M6 to convey the sheet bundle W about 10 mm from the conveyance roller pair 26.

In step S1113, the CPU 651 (the bundle control unit 711) stops the conveyance roller pair 24 and the conveyance roller pair 26 by stopping the motor M3 and the motor M6. The flowchart illustrated in FIG. 11 is then executed again for the subsequent sheet Pi+2.

In steps S1104, S1107, S1110, and S1112, the position of the sheet P or the sheet bundle W may be managed based on either the elapsed time or drive pulse count values, as described above. Additional sheet sensors may also be employed as described above.

According to the first embodiment, the shift amount is determined based on the delay amount of the sheet P. Additionally, according to the first embodiment, the shift amount is determined based on the alignment capabilities for the sheet P. Furthermore, according to the first embodiment, the shift amount is determined based on the delay amount of the sheet P and the alignment capabilities for the sheet P. For example, if the required alignment capabilities are low, the shift amount is reduced, which shortens the overall length of the sheet bundle W including the sheet P for which the conveyance was delayed. As a result, the time required for alignment is shortened. The time required to feed the sheet bundle W to the post-processing section 71 is shortened as well. In addition, the interval between the subsequent sheet P or the subsequent sheet bundle W and the preceding sheet bundle W is lengthened. As such, the subsequent sheet P or the subsequent sheet bundle W and the preceding sheet bundle W are less likely to make contact with each other. On the other hand, if the alignment capabilities are high, or if the sheet conveyance is not delayed, the shift amount of the sheet P is set to a sufficiently long value.

It is therefore possible to reduce the effect of delays in the conveyance of the sheets P while maintaining the alignment capabilities in the post-processing section 71. In other words, the conveyance and the post-processing of the sheets P can be continued.

As described above, according to the present embodiment, the shift amount between sheets in a sheet bundle W is determined based on the delay amount of the sheet P. This improves the productivity of the post-processing apparatus 4 while maintaining the shift amount required for longitudinal alignment.

Second Embodiment

In the first embodiment, the shift amount was determined according to the delay amount of the sheet P that occurs upstream from the buffer section 81. In a second embodiment, the shift amount for a subsequent sheet bundle W is determined based on the delay amount of a sheet bundle W that occurs downstream from the buffer section 81. In the second embodiment, the descriptions in the first embodiment will be used for matters that are the same as, or similar to, those in the first embodiment.

Delay Determination for Sheet Bundle

The post-processing apparatus 4 generates a sheet bundle W in the buffer section 81 and conveys the sheet bundle W to the post-processing section 71. When conveying a sheet bundle W from the buffer section 81 to the post-processing section 71, the conveyance of the sheet bundle W may be delayed due to roller slippage and the like. In addition, the plurality of sheets P constituting a sheet bundle W may shift during conveyance, increasing the overall length of the sheet bundle W. As a result, the timing at which the following end of the sheet bundle W enters the post-processing section 71 may be delayed. In the second embodiment, the delay determination unit 712 measures the conveyance time from the timing at which the conveyance of the sheet bundle W is started from the position indicated in FIG. 3D to when the sheet sensor 38 detects the leading end of the sheet bundle W. The delay determination unit 712 obtains the delay amount of the sheet bundle W from the ideal conveyance time, corresponding to a conveyance distance L_buff2 during the time described above, and the measured conveyance time. The delay determination unit 712 may also measure a transit time from when the leading end of the sheet bundle W is detected by the sheet sensor 38 to when the following end of the sheet bundle W is detected. The delay determination unit 712 obtains the delay amount of the following end of the sheet bundle W based on an ideal transit time and a measured transit time for the sheet bundle W.

For example, a delay amount T_bndl_delay1 of the leading end of the sheet bundle W can be calculated from the following equation.

$$T_bndl_delay1 = T_bndl_measure1 - T_bndl_ideal1 \quad \text{EQ3}$$

Here, T_bndl_measure1 represents the measured conveyance time. T_bndl_ideal1 represents the ideal conveyance time.

For example, a delay amount T_bndl_delay2 of the following end of the sheet bundle W can be calculated from the following equation.

$$T_bndl_delay2 = T_bndl_measure2 - T_bndl_ideal2 \quad \text{EQ4}$$

"T_bndl_measure2" indicates the measured transit time. "T_bndl_ideal2" indicates the ideal transit time. The ideal transit time T_bndl_ideal2 can be calculated from the following equation.

$$T_bndl_ideal2 = (L1 + L_shift \times (n-1))/V_bndl \quad \text{EQ5}$$

Here, n represents the total number of sheets P constituting the sheet bundle W. L1 represents the length of the sheet P in the conveyance direction. L_shift represents the shift amount of the sheet P. V_bndl represents the conveyance speed of the sheet bundle W. In this manner, the delay amounts T_bndl_delay1 and T_bndl_delay2 are calculated using time as a unit. However, these items may be calculated using the count value of motor drive pulses as a unit.

Delay Amount of Preceding Sheet Bundle and Shift Amount Applied to Subsequent Sheet Bundle In the second embodiment too, the shift amount may be determined based on the alignment capabilities and the delay amount. For example, the shift amount may be reduced according to the delay amount.

For example, if the required alignment capabilities are low, the shift amount is determined according to the delay amounts T_bndl_delay1 and T_bndl_delay2. On the other hand, if the required alignment capabilities are high, the shift amount is determined to be a fixed value, independent of the delay amounts T_bndl_delay1 and T_bndl_delay2. The delay amounts T_bndl_delay1 and T_bndl_delay2 are the delay amounts of the preceding sheet bundle with respect to the sheet bundle to which the shift amount is applied.

FIG. 5B illustrates a table holding shift amounts according to combinations of required alignment capabilities and delay amounts. This table may be stored in the ROM of the memory 652. If the required alignment capabilities are low, and the delay amount T_bndl_delay1 is less than 15 mm and at least 5 mm, the shift amount is determined to be 25 mm. Alternatively, if the required alignment capabilities are low, and the delay amount T_bndl_delay2 is less than 15 mm and at least 5 mm, the shift amount is determined to be 25 mm. If the required alignment capabilities are low, and both the delay amounts T_bndl_delay1 and T_bndl_delay2 are less than 5 mm, the shift amount is determined to be 30 mm. If the required alignment capabilities are high, the shift amount is set to 30 mm independent of the delay amount.

In a third embodiment too, it is assumed that the post-processing apparatus 4 can generate a sheet bundle W constituted by a maximum of four sheets P. When the shift amount is set to 25 mm, the overall length of the sheet bundle W is about 15 mm shorter than when the shift amount is a normal shift amount of 30 mm. In other words, the delay amount arising for the preceding sheet bundle Wi−1 is absorbed or canceled out by shortening the overall length of the subsequent sheet bundle Wi.

If the delay amount for the preceding sheet bundle Wi−1 is at least 15 mm, the delay amount cannot be fully absorbed by the subsequent sheet bundle Wi alone. In this case, the shift amount of the sheet bundle Wi and the shift amount of the subsequent sheet bundle Wi+1 are reduced. This case will be described in detail in the third embodiment. Although two levels are set for the shift amount according to the delay amount in the second embodiment, three or more levels may be set.

Flowchart

The flowchart of the first embodiment is also used in the second embodiment, but some of the steps are changed. The parts which are changed will therefore be described in detail. A case where the delay amount is at least 15 mm will not be described here.

Figure 12:
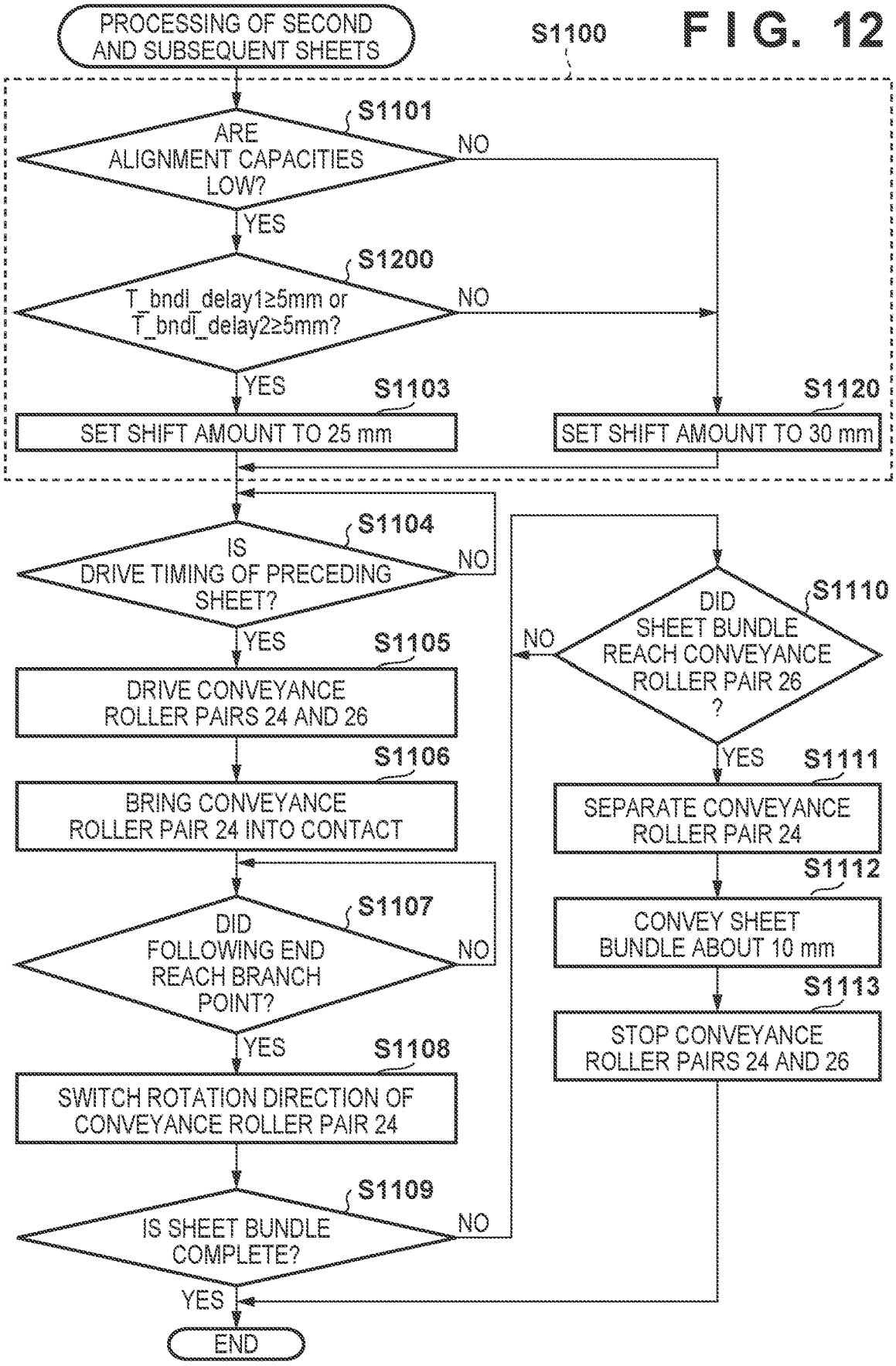
FIG. 12 is a flowchart illustrating a shift amount setting method.

FIG. 12 illustrates step S1100 of the second embodiment. As illustrated in FIG. 12, step S1102 described above has been replaced with step S1200. In step S1200, the CPU 651 (the delay determination unit 712) determines whether the delay amount T_bndl_delay1 or T_bndl_delay2 of the preceding sheet bundle Wi−1 is at least 5 mm. If both of the two delay amounts are less than 5 mm, the CPU 651 moves the sequence to step S1120. In step S1120, the CPU 651 sets the shift amount applied to the subsequent sheet bundle Wi to, for example, 30 mm. If at least one of the two delay amounts is at least 5 mm, the CPU 651 moves the sequence to step S1103. In step S1103, the CPU 651 sets the shift amount applied to the subsequent sheet bundle Wi to, for example, 25 mm.

Figure 13:
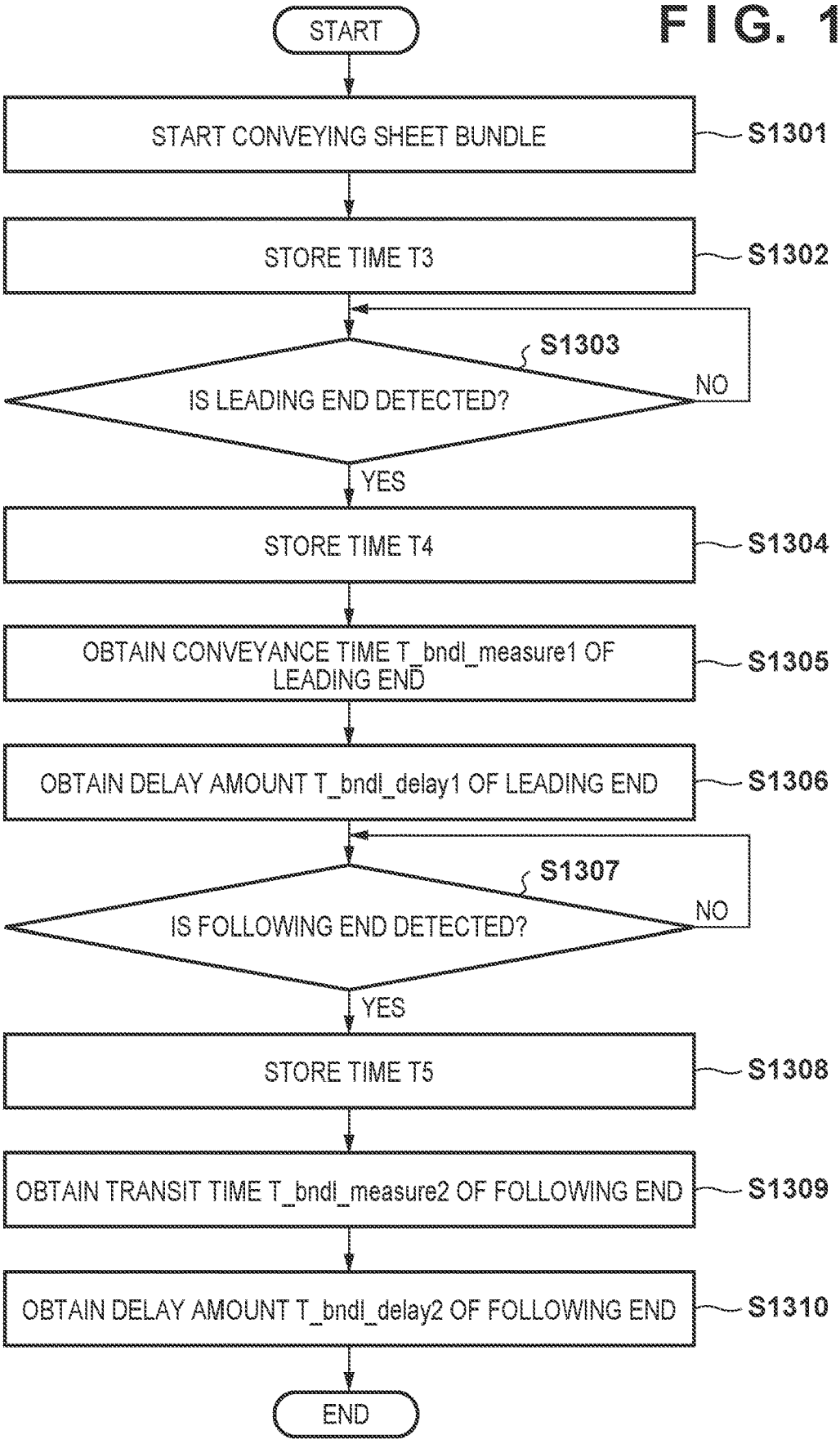
FIG. 13 is a flowchart illustrating a delay amount measurement method.

FIG. 13 is a flowchart illustrating processing for obtaining the delay amount of the sheet bundle W. The CPU 651 executes the following processing according to a control program stored in the ROM of the memory 652. Note that the leading end of the sheet bundle W stops about 10 mm downstream from the conveyance roller pair 26.

In step S1301, the CPU 651 (the conveyance control unit 710) starts driving the motors M3, M6, M7, and the like to start conveying the sheet bundle W. In step S1302, the CPU 651 obtains a time T3 from the RTC 655 and stores the time T3 in the RAM of the memory 652.

In step S1303, the CPU 651 (the delay determination unit 712) determines whether the leading end of the sheet bundle W has been detected by the sheet sensor 38. When the sheet sensor 38 detects the leading end of the sheet bundle W, the CPU 651 moves the sequence to step S1304.

In step S1304, the CPU 651 (the delay determination unit 712) obtains a time T4 from the RTC 655 and stores the time T4 in the RAM of the memory 652. In step S1305, the CPU 651 obtains the conveyance time T_bndl_measure1 of the leading end of the sheet bundle W based on the times T3 and T4.

$$T_\text{bndl_measure1}=T4-T3 \quad \text{EQ6}$$

In step S1306, the CPU 651 (the delay determination unit 712) obtains the delay amount T_bndl_delay1 of the leading end of the sheet bundle W based on the conveyance time T_bndl_measure1. Note that Equation EQ3 may be used at this time.

In step S1307, the CPU 651 (the delay determination unit 712) determines whether the following end of the sheet bundle W has been detected by the sheet sensor 38. When the sheet sensor 38 detects the following end of the sheet bundle W, the CPU 651 moves the sequence to step S1308.

In step S1308, the CPU 651 (the delay determination unit 712) obtains a time T5 from the RTC 655 and stores the time T5 in the RAM of the memory 652. In step S1309, the CPU 651 (the delay determination unit 712) obtains the time required for the entire sheet bundle W to pass the sheet sensor 38 (the transit time T_bndl_measure2) based on the times T4 and T5.

$$T_\text{bndl_measure2}=T5-T4 \quad \text{EQ7}$$

In step S1310, the CPU 651 (the delay determination unit 712) obtains the delay amount T_bndl_delay2 of the following end of the sheet bundle W based on the transit time T_bndl_measure2. Equation EQ4 may be used for this.

In this manner, according to the second embodiment, the shift amount applied to the subsequent sheet bundle Wi is set according to the delay amount of the preceding sheet bundle Wi−1 and the required alignment capabilities. This reduces the effect of delay in the sheet bundle W occurring downstream from the buffer section 81. For example, if the required alignment capabilities for a subsequent sheet bundle Wi are low, reducing the shift amount will reduce the overall length of the subsequent sheet bundle Wi. As a result, the time required for longitudinal alignment is shortened. Furthermore, the time required to feed the sheet bundle Wi to the post-processing section 71 is also shortened. In other words, a sufficient interval is maintained between the subsequent sheet bundle Wi and a further subsequent sheet bundle Wi+1, which makes jams less likely to occur. On the other hand, if the required alignment capabilities are high, or if the conveyance of the sheet bundle Wi−1 is not delayed, the shift amount of the sheet bundle Wi is set to a sufficiently long value.

According to the second embodiment, it is possible to reduce the effect of delay in the conveyance of sheet bundles W while maintaining the alignment capabilities. As such, even if a delay occurs for the preceding sheet bundle Wi−1, the conveyance and post-processing of the subsequent sheet bundles Wi and Wi+1 can continue.

According to the second embodiment, the shift amount of the subsequent sheet bundle Wi is determined according to the delay amount of the preceding sheet bundle Wi−1. This maintains the shift amount required for longitudinal alignment and improves the productivity of the post-processing apparatus 4.

Third Embodiment

A third embodiment describes measures for a case where there is a large delay amount for a sheet P or a sheet bundle W, mentioned in the second embodiment. In other words, if the delay amount is too large, reducing the shift amount for a single sheet P or a single sheet bundle W does not sufficiently reduce the effect of the delay. Furthermore, the delay will continue to affect the subsequent sheet bundles W.

Accordingly, in the third embodiment, when the delay amount is large, buildup of delay is suppressed by reducing each shift amount for a plurality of sheet bundles W. In addition, the delay amount may be large and the alignment capabilities required may be high. In such cases, other measures may be necessary. Such measures will be described hereinafter. In the third embodiment, the descriptions in the first or second embodiment will be used for matters that are the same as, or similar to, those in the first or second embodiment.

Delay Amount and Shift Amount

In the third embodiment, the first embodiment is applied when the alignment capabilities required for the post-processing section 71 to align sheet bundles are low. On the other hand, if the delay amount T_delay is greater than a threshold, a reduction in the shift amount is applied not only to the sheet bundle Wi, but also to the further subsequent sheet bundle Wi+1.

On the other hand, as mentioned in the first embodiment, it is difficult to reduce the shift amount when the required alignment capabilities are very high. Furthermore, as mentioned in the second embodiment, when the delay amount is too large, it becomes difficult to ensure a sufficient interval between the sheets even when reducing the shift amount, which makes it difficult to convey the sheets P and the sheet bundles W normally. Accordingly, in the third embodiment, the discharge destination of the sheet P is switched to a discharge bin located closest to the buffer section 81 (e.g., the upper tray 25), without generating a sheet bundle W, in order to reduce the occurrence of jams.

FIG. 5C is a table illustrating shift amounts, adjustment targets, and discharge destinations corresponding to combinations of alignment capabilities and delay amounts. This table, too, may be stored in the ROM of the memory 652. If the required alignment capabilities are low and the delay amount is at least a threshold Th2 (e.g., 15 mm), the shift amount is determined to be 25 mm. The reduction in the shift amount is applied to two consecutive sheet bundles. If the required alignment capabilities are low and the delay amount is less than the threshold Th2 and at least a threshold Th1 (e.g., 5 mm), the shift amount is determined to be 25 mm. The reduction in the shift amount is applied to a single sheet bundle W. If the delay amount is sufficiently small (e.g., if the delay amount is less than the threshold Th1), the shift amount is kept at a default value. In other words, a relatively large shift amount is selected. On the other hand, if the required alignment capabilities are high, the discharge destination of the sheet P is switched from the post-processing section 71 to the upper tray 25.

Flowcharts

Figure 14:
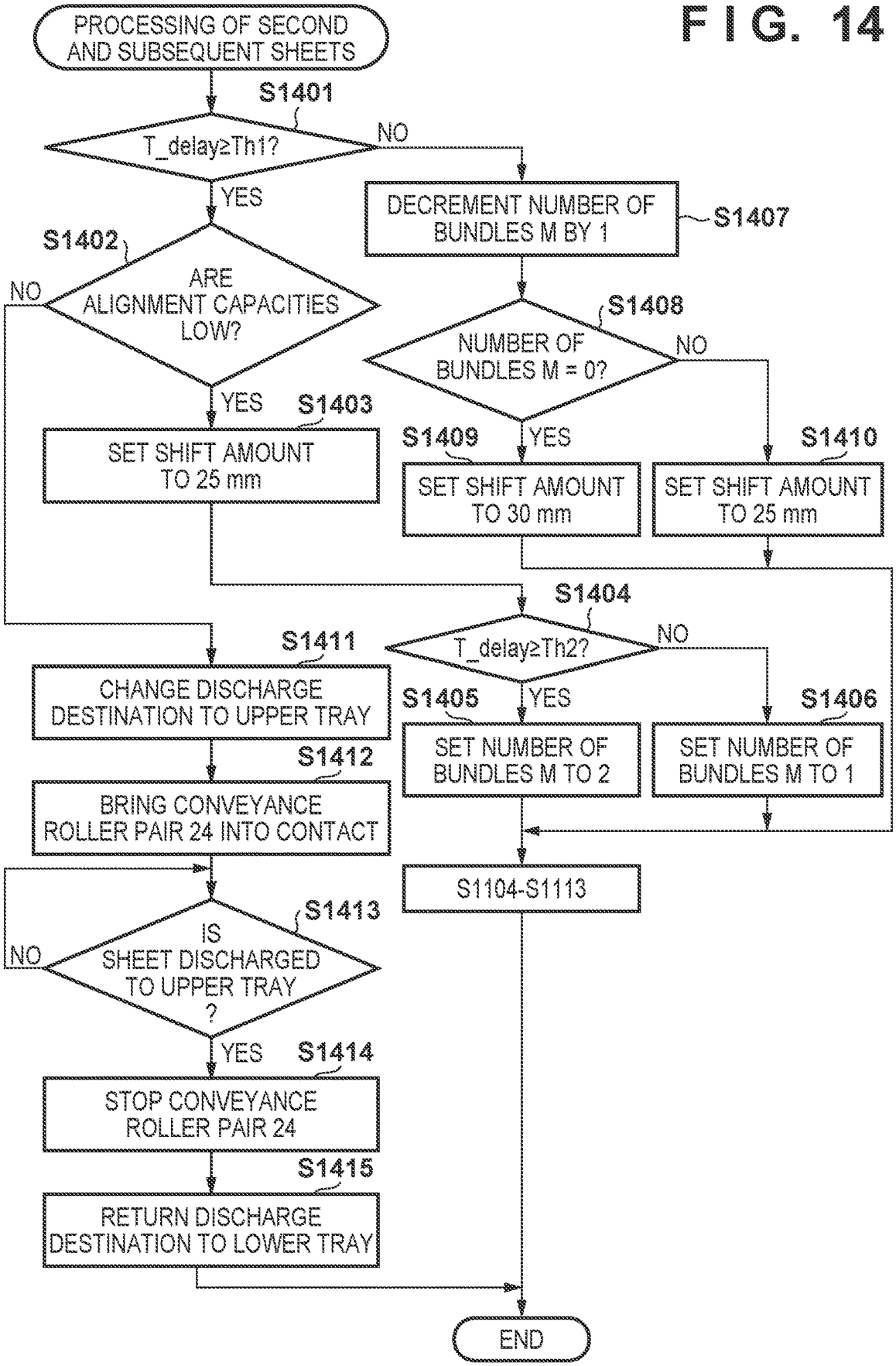
FIG. 14 is a flowchart illustrating processing applied to second and subsequent sheets.

FIG. 14 is a flowchart illustrating processing for the second and subsequent sheets P in the third embodiment. The ways in which the third embodiment differs from the first and second embodiments will mainly be described here as well. In particular, steps S1101 to S1103 in FIG. 11 have been changed to steps S1401 to S1415.

In step S1401, the CPU 651 (the delay determination unit 712) determines whether the delay amount T_delay is at least the threshold Th1 (e.g., 5 mm). If the delay amount T_delay is at least the threshold Th1, the CPU 651 moves the sequence to step S1402.

In step S1402, the CPU 651 (the capability determination unit 713) determines whether the required alignment capabilities are low. If the required alignment capabilities are low, the CPU 651 moves the sequence to step S1403.

In step S1403, the CPU 651 (the shift amount determination unit 714) sets the shift amount to 25 mm. In step S1404, the CPU 651 (the shift amount determination unit 714) determines whether the delay amount T_delay is at least the threshold Th2 (e.g., 15 mm). If the delay amount T_delay is at least the threshold Th2, the CPU 651 moves the sequence to step S1405. In step S1405, the CPU 651 (the shift amount determination unit 714) sets a number of bundles M, which is the total number of sheet bundles W for which the shift amount is adjusted, to 2. On the other hand, if the delay amount T_delay is determined to be less than the threshold Th2 in step S1404, the CPU 651 moves the sequence to step S1406. In step S1406, the CPU 651 (the shift amount determination unit 714) sets the number of bundles M to 1. The CPU 651 then executes steps S1104 to S1113.

The number of bundles M is a counter that counts the number of sheet bundles W for which the shift amount is to be reduced when the delay amount T_delay is large. If the number of bundles M is 2, the reduction in the shift amount is applied to both the sheet bundle Wi held in the bundle forming section 60 and the subsequent sheet bundle Wi+1.

If it is determined in step S1401 that the delay amount T_delay is less than Th1, the CPU 651 moves the sequence to step S1407. In step S1407, the CPU 651 (the shift amount determination unit 714) decrements the number of bundles M by 1. In other words, 1 is subtracted from the number of bundles M.

In step S1408, the CPU 651 (the shift amount determination unit 714) determines whether the number of bundles M is already 0. If the number of bundles M is 0, the CPU 651 moves the sequence to step S1409. In step S1409, the CPU 651 (the shift amount determination unit 714) sets the shift amount to 30 mm, rather than reducing the shift amount. The CPU 651 then executes steps S1104 to S1113.

If the number of bundles M is not 0 in step S1408, the CPU 651 moves the sequence to step S1410. In step S1410, the CPU 651 (the shift amount determination unit 714) sets the shift amount to 25 mm to reduce the shift amount. The CPU 651 then executes steps S1104 to S1113.

If the alignment capabilities are determined to be high in step S1402, the CPU 651 moves the sequence to step S1411. This is because a small value cannot be set for the shift amount when the alignment capabilities required for the post-processing section 71 are high.

In step S1411, the CPU 651 (the discharge destination selection unit 715) changes the discharge destination of the preceding sheet P and the subsequent sheet P present in the bundle forming section 60 from the lower tray 37 to the upper tray 25. In step S1412, the CPU 651 brings the conveyance roller pair 24 into contact. In step S1413, the CPU 651 determines whether a sheet P has been discharged to the upper tray. For example, it is determined whether the following end of the sheet P has exited the conveyance roller pair 24. This may be determined, for example, based on the time that has elapsed after the following end of the sheet P passed the sheet sensor 27. By bringing the conveyance roller pair 24 into contact, the preceding sheet P present in the bundle forming section 60 is also discharged to the upper tray 25. All sheets P that will constitute the same sheet bundle are discharged to the upper tray 25. When the sheet P is discharged, the CPU 651 moves the sequence to step S1414. In step S1414, the CPU 651 stops the conveyance roller pair 24 by stopping the motor M3. In step S1415, the CPU 651 (the discharge destination selection unit 715) returns the discharge destination to the lower tray 37.

Incidentally, there may be another sheet P that follows the sheet bundle discharged to the upper tray 25. If no delay has occurred for this other sheet P, the post-processing job may be resumed.

On the other hand, subsequent sheets P belonging to the same post-processing job as the post-processing job to which the sheet P discharged to the upper tray 25 belongs may also be discharged to the upper tray 25. In this case, the CPU 651 (the discharge destination selection unit 715) may change the discharge destination information of all subsequent sheets P belonging to the same post-processing job to the upper tray 25 in step S1415.

All of the specific values described in the first to third embodiments are merely examples. For example, in the third embodiment, the number of bundles M is set to a maximum of 2, but this number may instead be set to 3 or higher. Through this, the reduction in the shift amount may be applied to three or more sheet bundles W.

In the third embodiment, there are three combinations of the shift amount and the number of bundles M according to the delay amount of the sheet P, but four or more combinations may be provided. For example, there may be three or more options for the shift amount, and there may be three or more options for the number of bundles M.

According to the third embodiment, the shift amount of a subsequent plurality of sheet bundles W is determined based on the delay amount of the sheet P or the sheet bundle W. This improves the productivity of the post-processing apparatus 4 while maintaining the shift amount required for longitudinal alignment.

Technical Spirit Derived from Embodiments

Aspect 1

The image forming apparatus 1 is an example of a conveyance apparatus in a preceding stage. The "conveyance apparatus in a stage preceding the post-processing apparatus" is a conveyance apparatus present upstream from the post-processing apparatus in the conveyance direction of the sheets. The conveyance apparatus in the stage may be connected to the post-processing apparatus directly, or may be connected to the post-processing apparatus indirectly. In other words, another conveyance apparatus may be interposed between the conveyance apparatus in the stage and the post-processing apparatus. The conveyance path R1 is an example of a first conveyance path. The buffer section 81 and the bundle forming section 60 function as a buffer unit (buffer mechanism). The conveyance path R2 is an example of a second conveyance path. The post-processing section 71 is an example of a post-processing unit (a post-processing machine). The CPU 651 is an example of a control unit (a processor).

According to the first and third embodiments, the CPU 651 obtains a delay amount of a sheet conveyed from the conveyance apparatus in the stage and, based on the delay amount, sets a shift amount between a plurality of the sheets constituting the sheet bundle in the buffer unit. According to the second embodiment, the CPU 651 obtains a delay amount of a preceding other sheet bundle conveyed from the buffer unit to the post-processing unit and, based on the delay amount, sets a shift amount between a plurality of the sheets constituting the sheet bundle in the buffer unit. This makes it easier to achieve normal conveyance of sheets or sheet bundles in the post-processing apparatus 4.

Aspect 2

The half-moon roller 33 and the alignment reference plate 39 are an example of an alignment unit.

Taking the alignment capabilities required for aligning the sheet bundle into account in this manner makes the alignment of the sheet bundle less likely to fail. In addition, the shift amount can be reduced while maintaining the alignment accuracy of the sheet bundle.

Aspects 3 and 4

The environmental sensor 721 is an example of a detection unit that detects an environmental condition of a surrounding environment in which the post-processing apparatus is installed.

For example, a high-temperature and high-humidity environment increases the friction between sheets, and thus higher alignment capabilities are required. Accordingly, by taking environmental conditions into account, the shift amount can be reduced while maintaining the alignment accuracy of the sheet bundle.

Aspect 5

The operation unit 5 and the CPU 651 are an example of an obtainment unit.

Friction acting between sheets varies depending on the type of the sheets. Accordingly, by taking the type of the sheets into account, the shift amount can be reduced while maintaining the alignment accuracy of the sheet bundle. Note that one or both of the environmental conditions and the type information may be taken into account as parameters affecting the alignment capabilities.

Aspect 6

The surface area, size, basis weight, and surface finish processing of the sheets all affect the friction acting between the sheets. Accordingly, by taking the type of the sheets into account, the shift amount can be reduced while maintaining the alignment accuracy of the sheet bundle.

Aspect 7

A large shift amount is set when the delay amount is small, and a small shift amount is set when the delay amount is large. In other words, an appropriate shift amount is set according to the delay amount.

Aspect 8

If the delay amount is very large, maintaining normal conveyance may not be possible simply by adjusting the shift amount alone. Similarly, if the required alignment capabilities are very large, maintaining normal conveyance may not be possible simply by adjusting the shift amount alone. In such cases, the CPU 651 may discharge the sheets to the upper tray 25 without going through the post-processing section 71. This makes it possible to suppress the occurrence of jams inside the post-processing apparatus 4.

Aspect 9

If the required alignment capabilities are very large, maintaining normal conveyance may not be possible simply by adjusting the shift amount alone. In such cases, the CPU 651 may discharge the sheets to the upper tray 25 without going through the post-processing section 71. This makes it possible to suppress the occurrence of jams inside the post-processing apparatus 4.

Aspect 10

When a sheet bundle for which normal conveyance cannot be ensured even after adjusting the shift amount is produced, a subsequent sheet bundle is also discharged to outside the post-processing apparatus 4 without conveying the sheet bundle to the post-processing section 71.

Aspect 11

The conveyance destination of the sheet (e.g., the upper tray 25, the lower tray 37, or the post-processing section 71) may be selected according to the delay amount. For example, a sheet bundle can be discharged to outside the post-processing apparatus 4 without being conveyed to the post-processing section 71.

Aspect 12

If the delay amount is too large, it may be difficult to achieve normal conveyance simply by reducing the shift amount for a single sheet or a single sheet bundle. Accordingly, normal conveyance may be achieved by reducing the shift amount for at least two sheets or at least two sheet bundles.

Aspect 13

The delay amount may be obtained based on a conveyance time from a timing at which the sheet passes a first conveyance position (e.g., the sheet sensor 17) to a timing at which the sheet passes a second conveyance position (e.g., the sheet sensor 27).

This makes it possible to accurately detect a delay amount occurring upstream from the post-processing apparatus 4. An appropriate shift amount can be determined as a result.

Aspect 14

The timing at which the sheet passes a predetermined position may be recognized based on a signal such as the report signal S1 in this manner.

Aspect 15

A detection unit (e.g., the sheet sensor 38) that detects, at a predetermined position, the preceding other sheet bundle conveyed from the second conveyance path to the post-processing unit may further be provided.

The delay amount of the preceding other sheet bundle may be obtained based on the timing at which the sheet sensor 38 detects the preceding other sheet bundle.

This ensures that the delay amount occurring downstream from the buffer section 81 is detected accurately. An appropriate shift amount can be determined as a result.

Aspect 16

The shift amount may be determined by taking into account both the delay amount occurring upstream from the bundle forming section 60 and the delay amount occurring downstream.

Aspect 17

In this manner, the shift amount is reduced when at least one of the two delay amounts suggests the possibility of a jam occurring in the future. Normal conveyance is maintained as a result.

Aspect 18

The memory 652 is an example of a storage unit that stores a usage history of the post-processing apparatus. For example, the CPU 651 may set the shift amount based on (i) the delay amount and (ii) the usage history, which is a parameter that affects the alignment capabilities.

The more the post-processing apparatus 4 is used, the more the conveyance capabilities of the conveyance roller pairs 21, 22, 24, 26, and 28 can decrease. Similarly, the alignment capabilities of the half-moon roller 33 can decrease. This means that the usage history is correlated with the alignment capabilities. It is therefore possible to set a more appropriate shift amount by setting the shift amount while taking the usage history into account.

Aspect 19

The number of sheets and operating time are correlated with a drop in the alignment capabilities of the half-moon roller 33. Accordingly, a more appropriate shift amount can be set by taking these factors into account.

Aspect 20

The CPU 651 receives post-processing instructions from the printer controller 600 and executes post-processing according to the post-processing instructions. The post-processing apparatus 4 executes post-processing on the sheet P, outputs the sheet P to the upper tray 25 or the lower tray 37 without performing post-processing on the sheet P, or the like. Accordingly, a drop in the alignment capabilities of the half-moon roller 33 depends on the post-processing instructions. If the CPU 651 stores the post-processing instructions in the memory 652 as a usage history, the alignment capabilities of the half-moon roller 33 can be estimated more accurately.

Aspect 21

The conveyance roller pair 22 is an example of a first conveyance roller pair. The conveyance roller pair 24 is an example of a second conveyance roller pair. The conveyance roller pair 26 is an example of a third conveyance roller pair.

According to Aspect 21, a method of generating a sheet bundle using switch-back conveyance is realized. Switch-back conveyance has advantages such as reducing the length of the conveyance path needed to stack sheets. On the other hand, when a sheet delay occurs, the interval between a preceding sheet and a subsequent sheet decreases, making interference with the normal conveyance of sheets likely to occur. A method that adjusts the shift amount according to the delay amount is therefore advantageous.

Aspect 22

In this manner, the shift amount may be adjusted by adjusting the drive timing of the conveyance roller pairs.

Aspect 23

The motor M4 is an example of a switching unit that switches the second conveyance roller pair between a contact state and a separated state.

In this manner, bringing the two rollers constituting the conveyance roller pair into contact or separating the rollers from each other makes it possible to generate sheet bundles smoothly.

Aspect 24

The backflow prevention valve 23 is an example of a guiding member that guides sheets or sheet bundles from the buffer unit to the second conveyance path.

This makes it possible to generate sheet bundles smoothly using switch-back conveyance.

Aspect 25

A post-processing apparatus included in an image forming system may be the post-processing apparatus according to any one of Aspects 2 to 24.

The present disclosure is not limited to the above embodiments and various changes and modifications can be made within the spirit and scope of the present disclosure. Therefore, to apprise the public of the scope of the present disclosure, the following claims are made.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-068471, filed Apr. 18, 2022 which is hereby incorporated by reference herein in its entirety.

What is claimed is:

1. A post-processing apparatus comprising:

a first conveyance path configured to receive a sheet that has been conveyed from a conveyance apparatus in a stage preceding the post-processing apparatus, and to convey the sheet;

a buffer unit configured to form a sheet bundle constituted by a predetermined number of sheets by stacking the predetermined number of sheets conveyed from the first conveyance path while shifting the sheets in a conveyance direction;

a second conveyance path connected to the buffer unit and configured to convey the sheet bundle;

a post-processing unit configured to load the sheet bundle conveyed from the second conveyance path and to perform post-processing on the sheet bundle; and at least one processor configured to perform operations including:

controlling conveyance of the sheets and the sheet bundle, obtaining, in a case of a delay amount, a delay amount of the sheet conveyed from the conveyance apparatus in the stage or a delay amount of a preceding other sheet bundle conveyed from the buffer unit to the post-processing unit, and setting a shift amount between plural sheets of the sheets constituting the sheet bundle in the buffer unit based on the delay amount obtained by the at least one processor.

2. The post-processing apparatus according to claim 1, wherein the post-processing unit includes an alignment unit configured to align the sheet bundle, and the setting includes setting the shift amount based on (i) the obtained delay amount and (ii) alignment capabilities required of the alignment unit to align the sheet bundle.

3. The post-processing apparatus according to claim 2, further comprising a sensor configured to detect, as a parameter that affects the alignment capabilities, an environmental condition of a surrounding environment in which the post-processing apparatus is installed, wherein the setting includes setting the shift amount based on (i) the obtained delay amount and (ii) the environmental condition detected by the sensor.

4. The post-processing apparatus according to claim 3, wherein the environmental condition includes at least one of the following: a temperature in the surrounding environment or a humidity in the surrounding environment.

5. The post-processing apparatus according to claim 2, further comprising an obtainment unit configured to obtain, as a parameter that affects the alignment capabilities, type information indicating a type of the sheet, wherein the setting includes setting the shift amount based on (i) the obtained delay amount and (ii) the type information obtained by the obtainment unit.

6. The post-processing apparatus according to claim 5, wherein the type information includes at least one of the following: a surface area of a surface of the sheet, finishing processing applied to the surface of the sheet, and a basis weight of the sheet.

7. The post-processing apparatus according to claim 2, wherein the at least one processor is further configured to perform operations including:

adjusting the shift amount and conveys the sheet bundle to the post-processing unit when the alignment capabilities are relatively low, and discharging the sheet bundle to outside the post-processing apparatus, without conveying the sheet bundle to the post-processing unit, when the alignment capabilities are relatively high.

8. The post-processing apparatus according to claim 7, wherein discharging the sheet bundle includes discharging a subsequent sheet bundle, that is subsequent to the sheet bundle, to the outside of the post-processing apparatus without conveying the subsequent sheet bundle to the post-processing unit.

9. The post-processing apparatus according to claim 1, wherein the setting includes setting the shift amount to a first shift amount when the obtained delay amount is less than a first threshold, and includes setting the shift amount to a second shift amount smaller than the first shift amount when the obtained delay amount is at least equal to or greater than the first threshold.

10. The post-processing apparatus according to claim 9, wherein the at least one processor is further configured to perform operations including discharging the sheet bundle to outside the post-processing apparatus, without conveying the sheet bundle to the post-processing unit, when the obtained delay amount is at least a second threshold that is greater than the first threshold.

11. The post-processing apparatus according to claim 9, wherein the setting includes setting the shift amount to the second shift amount for a plurality of sheet bundles when the obtained delay amount is at least a third threshold that is greater than the first threshold.

12. The post-processing apparatus according to claim 1, wherein the at least one processor is further configured to perform operations including selecting a conveyance destination of the sheet conveyed from the conveyance apparatus in the stage according to the obtained delay amount.

13. The post-processing apparatus according to claim 1, wherein obtaining the delay amount of the sheet conveyed from the conveyance apparatus in the stage is based on a conveyance time from a first timing at which the sheet passes a first conveyance position in the conveyance apparatus in the stage to a second timing at which the sheet passes a second conveyance position in the first conveyance path.

14. The post-processing apparatus according to claim 13, wherein the at least one processor is further configured to perform operations including confirming the first timing at which the sheet passes the first conveyance position in the conveyance apparatus in the stage based on a signal transmitted by the conveyance apparatus in the stage.

15. The post-processing apparatus according to claim 1, further comprising a sensor configured to detect, at a predetermined position, the preceding other sheet bundle conveyed from the second conveyance path to the post-processing unit, wherein obtaining the delay amount of the preceding other sheet bundle is based on a timing at which the sensor detects the preceding other sheet bundle.

16. The post-processing apparatus according to claim 15, wherein the obtaining includes obtaining a first delay amount that is a delay amount of a leading end of the preceding other sheet bundle based on a first timing at which the sensor detects the leading end of the preceding other sheet bundle, and obtaining a second delay amount that is a delay amount of a following end of the preceding other sheet bundle based on a second timing at which the sensor detects the following end of the preceding other sheet bundle, and wherein the setting includes setting the shift amount between the plural sheets of the sheets constituting the sheet bundle in the buffer unit based on the first delay amount and the second delay amount.

17. The post-processing apparatus according to claim 16, wherein the setting includes setting the shift amount to a first shift amount when both the first delay amount and the second delay amount are less than a first threshold, and setting the shift amount to a second shift amount smaller than the first shift amount when at least one of the first delay amount and the second delay amount is at least the first threshold.

18. The post-processing apparatus according to claim 1, further comprising:

a first conveyance roller pair;

a second conveyance roller pair; and a third conveyance roller pair, wherein the at least one processor is further configured to perform operations including:

causing a passed sheet passed from the first conveyance roller pair to be drawn into the buffer unit by causing the second conveyance roller pair to rotate in reverse, causing the passed sheet to be passed to the third conveyance roller pair by causing the second conveyance roller pair to rotate in reverse upon a following end of the passed sheet reaching a position where the following end can be fed to the second conveyance path, and then causing the second conveyance roller pair and the third conveyance roller pair to stop, generating a generated sheet bundle by causing the second conveyance roller pair and the third conveyance roller pair to rotate in reverse upon a subsequent sheet, that is subsequent to the passed sheet, reaching the second conveyance roller pair, such that the passed sheet and the subsequent sheet are stacked in the buffer unit, and causing, when the sheet bundle constituted by the predetermined number of sheets is complete in the buffer unit, the second conveyance roller pair and the third conveyance roller pair to rotate forward to feed the sheet bundle to the second conveyance path.

19. The post-processing apparatus according to claim 18, wherein the at least one processor is further configured to perform operations including changing the shift amount by changing a timing at which to cause the third conveyance roller pair to rotate in reverse.

20. An image forming system comprising:

an image forming apparatus configured as a preceding stage to form an image on a sheet; and a post-processing apparatus to perform post-processing on a sheet conveyed from the image forming apparatus, wherein the post-processing apparatus includes:

a first conveyance path configured to receive the sheet that has been conveyed from the image forming apparatus in the stage, and to convey the sheet, a buffer unit configured to form a sheet bundle constituted by a predetermined number of sheets by stacking the predetermined number of sheets conveyed from the first conveyance path while shifting the sheets in a conveyance direction, a second conveyance path connected to the buffer unit and configured to convey the sheet bundle, a post-processing unit configured to load the sheet bundle conveyed from the second conveyance path and to perform the post-processing on the sheet bundle, and at least one processor configured to perform operations including:

controlling conveyance of the sheets and the sheet bundle, obtaining, in a case of a delay amount, a delay amount of the sheet conveyed from the image forming apparatus in the stage or a delay amount of a preceding other sheet bundle conveyed from the buffer unit to the post-processing unit, and setting a shift amount between plural sheets of the sheets constituting the sheet bundle in the buffer unit based on the delay amount obtained by the at least one processor.

* * * * *